US011024233B2

(12) United States Patent
Park et al.

(10) Patent No.: US 11,024,233 B2
(45) Date of Patent: Jun. 1, 2021

(54) DISPLAY DEVICE AND DISPLAY PANEL

(71) Applicant: LG DISPLAY CO., LTD., Seoul (KR)

(72) Inventors: JaeHoon Park, Gyeonggi-do (KR); SeonYeong Kim, Seoul (KR)

(73) Assignee: LG DISPLAY CO., LTD., Seoul (KR)

( * ) Notice: Subject to any disclaimer, the term of this patent is extended or adjusted under 35 U.S.C. 154(b) by 3 days.

(21) Appl. No.: 16/563,397

(22) Filed: Sep. 6, 2019

(65) Prior Publication Data

US 2020/0118494 A1 Apr. 16, 2020

(30) Foreign Application Priority Data

Oct. 11, 2018 (KR) ..... 10-2018-0121359

(51) Int. Cl.
*G09G 3/3266* (2016.01)
*G09G 3/3258* (2016.01)
*G09G 3/3291* (2016.01)

(52) U.S. Cl.
CPC ..... *G09G 3/3266* (2013.01); *G09G 3/3258* (2013.01); *G09G 3/3291* (2013.01); *G09G 2300/0426* (2013.01); *G09G 2300/0842* (2013.01); *G09G 2330/04* (2013.01)

(58) Field of Classification Search
None
See application file for complete search history.

(56) References Cited

U.S. PATENT DOCUMENTS

| | | | | |
|---|---|---|---|---|
| 10,365,778 | B2 * | 7/2019 | Kim | H01L 27/3276 |
| 2011/0199358 | A1 | 8/2011 | Chung | |
| 2012/0161637 | A1 | 6/2012 | Lee et al. | |
| 2014/0111503 | A1 * | 4/2014 | Kwon | G09G 3/3233 345/213 |
| 2016/0019844 | A1 * | 1/2016 | Yang | G09G 3/3233 345/205 |
| 2016/0104423 | A1 * | 4/2016 | Park | G09G 3/3233 345/78 |
| 2016/0125809 | A1 | 5/2016 | Hwang | |
| 2016/0379571 | A1 | 12/2016 | Kim et al. | |
| 2017/0193876 | A1 | 7/2017 | Choi et al. | |
| 2017/0194406 | A1 | 7/2017 | Choi et al. | |
| 2017/0256601 | A1 | 9/2017 | Kim et al. | |
| 2018/0114488 | A1 | 4/2018 | Jung | |
| 2018/0284927 | A1 * | 10/2018 | Kim | H01L 27/3272 |

FOREIGN PATENT DOCUMENTS

| | | | |
|---|---|---|---|
| KR | 10-2016-0061474 | A | 6/2016 |
| KR | 10-2017-0079541 | A | 7/2017 |

* cited by examiner

*Primary Examiner* — Duane N Taylor, Jr.
(74) *Attorney, Agent, or Firm* — Birch, Stewart, Kolasch & Birch, LLP

(57) ABSTRACT

A display device can include a display panel including a plurality of data lines, a plurality of scan lines, a plurality of light emission control lines, and a plurality of sub-pixels; a first driving circuit configured to drive the plurality of data lines; a second driving circuit configured to drive the plurality of scan lines; and a third driving circuit configured to drive the plurality of light emission control lines, in which the display panel includes an active area in which an image is displayed and a non-active area which is an edge area of the active area.

15 Claims, 13 Drawing Sheets

DISPLAY DEVICE AND DISPLAY PANEL

CROSS REFERENCE TO RELATED APPLICATION

This application claims the benefit of priority under 35 U.S.C. § 119(a) to Korean Patent Application No. 10-2018-0121359, filed in the Republic of Korea on Oct. 11, 2018, the entirety of which is hereby incorporated by reference for all purposes as if fully set forth herein.

BACKGROUND OF THE INVENTION

1. Field of the Invention

The present disclosure relates to a display device and a display pad.

2. Description of the Prior Art

As information-oriented society has developed, demand for display devices for displaying an image has increased in various manners. Also, various types of display devices are being utilized, such as a Liquid Crystal Display (LCD), a Plasma Display Panel (PDP), an Organic Light Emitting Diode (OLED) display, and the like.

As display technology has been developed, the sub-pixel structure of a display device has become complex, or the types and the number of signal wirings has increased. As described above, when the sub-pixel structure becomes complex and the types and the number of signal wirings increase, the aperture ratio of a display panel decreases and the quality of image decreases.

SUMMARY OF THE INVENTION

An aspect of the present disclosure is to provide a display device and a display panel having a high aperture ratio.

Another aspect of the present disclosure is to provide a display device and a display panel which prevent a short-circuit between a data voltage and a reference voltage having different voltage values during driving.

Another aspect of the present disclosure is to provide a display device and display panel which increase an aperture ratio via integration of scan lines, and prevent a short-circuit between a data voltage and a reference voltage during driving.

Another aspect of the present disclosure is to provide a display device and a display panel having a high transparency.

Another aspect of the present disclosure is to provide a display device and a display panel which extend a transparent area via a superposition structure of different types of signal wirings.

Another aspect of the present disclosure is to provide a display device and a display panel which extend a transparent area by designing the display device and the display panel such that common signal wirings in the column direction (or the row direction) are shared by adjacent sub-pixels, and signal wirings in the column direction (or the row direction) are not disposed in the boundary between two sub-pixel areas among four sub-pixel areas.

Another aspect of the present disclosure is to provide a display device and a display panel which extend a transparent area by decreasing the number of signal wirings in the row direction (or column direction).

In accordance with an aspect of the present disclosure, a display device can include: a display panel in which a plurality of data lines, a plurality of scan lines, and a plurality of light emission control lines are disposed, and a plurality of sub-pixels are disposed; a first driving circuit configured to drive the plurality of data lines; a second driving circuit configured to drive the plurality of scan lines; and a third driving circuit configured to drive the plurality of light emission control lines.

The display panel can include an active area in which an image is displayed and a non-active area which is an edge area of the active area.

Each of the plurality of sub-pixels can include: a light emitting device which is electrically connected between a base voltage and a first node; a driving transistor which is electrically connected between a driving voltage line and a second node; a storage capacitor which is electrically connected between a third node and a fourth node; a first light emission control transistor which is electrically connected between the first node and the second node; a second light emission control transistor which is electrically connected between the fourth node and a reference voltage line; a first scan transistor which is electrically connected between the fourth node and a corresponding data line; a second scan transistor which is electrically connected between the second node and the third node; and a third scan transistor which is electrically connected between the first node and the corresponding reference voltage line.

A gate node of the first scan transistor, a gate node of the second scan transistor, and a gate node of the third scan transistor can be electrically connected to a single scan line. The gate node of the first light emission control transistor and the gate node of the second light emission control transistor are electrically connected to a single light emission control line.

The display device can further include a data control transistor disposed to correspond to each of the plurality of data lines.

The data control transistor can be disposed in the non-active area of the display panel to which the first driving circuit is electrically connected.

The data control transistor can be controlled by a sampling signal, and can control whether to connect the first driving circuit and the data line.

A part or the whole of the driving voltage line can overlap the reference voltage line.

A protrusion of the reference voltage line and the data line can intersect and overlap each other.

A protrusion of the reference voltage line and an active layer (e.g., referred to as "semiconductor layer") of the first scan transistor can intersect and partially overlap each other.

A part of the active layer of the first scan transistor and the data line can overlap each other.

A protrusion of the light emission control line can be disposed between the first node and the second node.

The storage capacitor can include a first plate and a second plate, the first plate can be disposed in a same substance layer as that of the light emission control line or the scan line, and the second plate can be disposed in a same substance layer as that of one of the reference voltage line, the driving voltage line, and the data line.

A part of the active layer of the driving transistor can overlap the storage capacitor. Another part of the active layer of the driving transistor and the data line can intersect and overlap each other.

A method of driving a sub-pixel of a display device can include an initialization operation, a sampling operation, a pre-light emission operation, and a light emission operation, and the like.

In the initialization operation, when the first scan transistor, the second scan transistor, and the third scan transistor are in the turned-on state, and the first light emission control transistor and the second light emission control transistor are in the turned-on state, a reference voltage can be provided to the second node, the third node, and the fourth node, and the data control transistor may be turned off.

In the initialization operation, when the data control transistor is turned off, the first driving circuit and the data line are opened (e.g., electrical disconnection).

In the sampling operation, when the first scan transistor, the second scan transistor, and the third scan transistor are in the turned-on state, and the first light emission control transistor and the second light emission control transistor are in the turned-off state, the data control transistor is turned on. As the data control transistor is turned on, the first driving circuit and the data line are electrically connected, and a data voltage can be provided to the fourth node.

In the sampling operation, when the first scan transistor, the second scan transistor, and the third scan transistor are turned on, and the data control transistor is turned on, and a data voltage is provided to the fourth node, the first light emission control transistor and the second light emission control transistor can be in the turned-off state.

In the pre-light emission operation, when the first scan transistor, the second scan transistor, and the third scan transistor are in the turned-off state, and the first light emission control transistor and the second light emission control transistor are in the turned-off state, the data control transistor can be turned off.

In the light emission operation, when the first scan transistor, the second scan transistor, and the third scan transistor are in the turned off state, and the first light emission control transistor and the second light emission control transistor are in the turned-on state, the data control transistor can be turned on.

In the light emission operation, the first scan transistor, the second scan transistor, and the third scan transistor are turned off, the data control transistor is turned on, the first light emission control transistor and the second light emission control transistor are turned on, a voltage of the fourth node changes, and the light emitting device emits light.

During a first period, a reference voltage is provided to a first plate and a second plate of the storage capacitor, and the data control transistor is turned off, whereby the second plate and the first driving circuit are electrically disconnected from each other.

During a second period after the first period, as the data control transistor is turned on, the second plate and the first driving circuit can be electrically connected to each other.

An area of each of the plurality of sub-pixels can include a circuit area, a light emission area, and a transparent area.

The driving transistor, the first to third scan transistors, the first and second light emission control transistors, and the storage capacitor can be disposed in the circuit area.

The light emission area can overlap the circuit area, and the transparent area can be an edge area of the circuit area and the light emission area.

The plurality of sub-pixels may include a first sub-pixel and a second sub-pixel which are adjacent to each other in a first direction (e.g., the row direction or the column direction), a signal wiring in a second direction (e.g., the column direction or the row direction) can be disposed in an opposite side of a side corresponding to a boundary with the second sub-pixel among both sides of the first sub-pixel, a signal wiring in the second direction (e.g., the column direction or the row direction) can be disposed in an opposite side of a side corresponding to a boundary with the first sub-pixel among both sides of the second sub-pixel, and signal wirings in the second direction (e.g., the column direction or the row direction) may not be disposed in a boundary area between the first sub-pixel and the second sub-pixel.

In accordance with another aspect of the present disclosure, a display panel can include: a plurality of sub-pixels which are defined by a plurality of data lines and a plurality of scan lines, each including a light emitting device, a driving transistor, a scan transistor, and a storage capacitor; a pad to which a first driving circuit is electrically connected, and which is disposed in a non-active area which is an edge area of an active area in which an image is displayed; and a data control transistor which is disposed between the pad and the plurality of data lines, corresponds to each of the plurality of data lines, and controls whether to connect a corresponding data line and the first driving circuit.

During a first period, a reference voltage is provided to a first plate and a second plate of the storage capacitor, and the data control transistor is turned off, whereby the second plate and the first driving circuit are electrically disconnected from each other.

During a second period after the first period, as the data control transistor is turned on, the second plate and the first driving circuit can be electrically connected to each other.

As described above, according to the present disclosure, a display device and a display panel which have a high aperture ratio can be provided.

Further, in another aspect, the present disclosure can provide a display device and a display panel which prevent a short-circuit between a data voltage and a reference voltage having different voltage values during driving.

Further, in another aspect, the present disclosure can provide a display device and display panel which increase an aperture ratio via integration of scan lines, and which prevent a short-circuit between a data voltage and a reference voltage during driving.

Further, in another aspect, the present disclosure can provide a display device and a display panel having a high transparency.

Further, in another aspect, the present disclosure can provide a display device and a display panel which extend a transparent area via a superposition structure of different types of signal wirings.

Further, in another aspect, the present disclosure can provide a display device and a display panel which extend a transparent area by designing the display device and the display panel such that common signal wirings in the column direction (or the row direction) are shared by adjacent sub-pixels, and signal wirings in the column direction (or the row direction) are not disposed in the boundary between two sub-pixel areas among four sub-pixel areas.

Further, in another aspect, the present disclosure can provide a display device and a display panel which extend a transparent area by decreasing the number of signal wirings in the row direction (or column direction).

BRIEF DESCRIPTION OF THE DRAWINGS

The above and other aspects, features and advantages of the present disclosure will be more apparent from the following detailed description taken in conjunction with the accompanying drawings, in which.

DETAILED DESCRIPTION OF THE EMBODIMENTS

Figure 1:
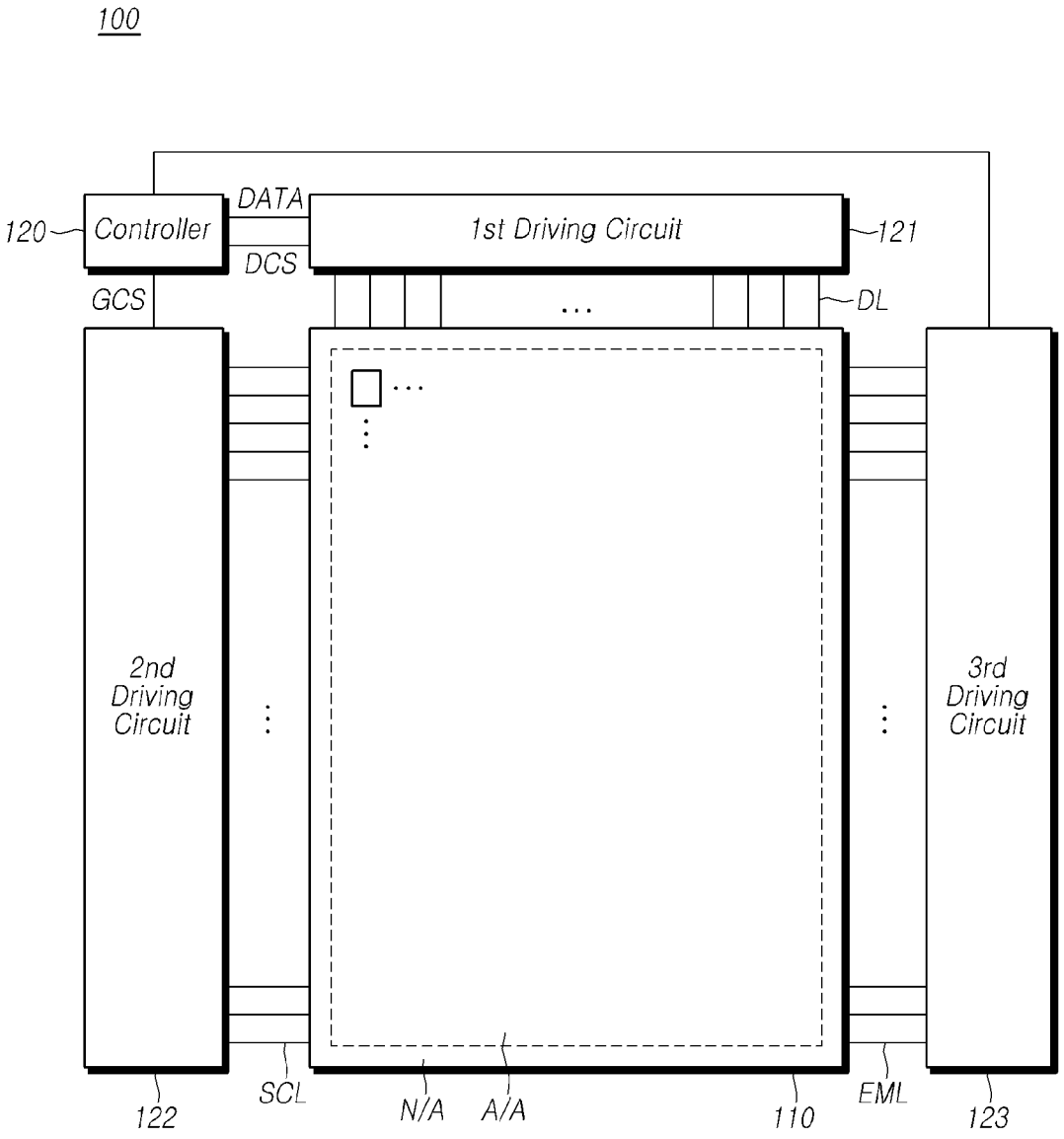
FIG. 1 is a diagram schematically illustrating the configuration of a system of a display device according to embodiments of the present disclosure.

Hereinafter, some embodiments of the present disclosure will be described in detail with reference to the accompanying illustrative drawings. In designating elements of the drawings by reference numerals, the same elements will be designated by the same reference numerals although they are shown in different drawings. Further, in the following description of the present disclosure, a detailed description of known functions and configurations incorporated herein will be omitted when it may make the subject matter of the present disclosure rather unclear.

In addition, terms, such as first, second, A, B, (a), (b) or the like may be used herein when describing components of the present disclosure. Each of these terminologies is not used to define an essence, order or sequence of a corresponding component but used merely to distinguish the corresponding component from other component(s). In the situation that it is described that a certain structural element "is connected to," "is coupled to," or "is in contact with" another structural element, it should be interpreted that another structural element may "be connected to," "be coupled to," or "be in contact with" the structural elements as well as that the certain structural element is directly connected to or is in direct contact with another structural element.

FIG. 1 is a diagram schematically illustrating the configuration of a system of a display device 100 according to embodiments of the present disclosure.

Referring to FIG. 1, the display device 100 according to various embodiments of the present disclosure can include a display panel 110, in which a plurality of data lines (DL), a plurality of scan lines (SCL), and a plurality of light emission control lines (EML) are disposed, and a plurality of sub-pixels (SP) are disposed, and a driving circuit for driving the display panel 110.

In terms of function, the driving circuit can include a first driving circuit 121 for driving a plurality of data lines (DL), a second driving circuit 122 for driving a plurality of scan lines (SCL), and a third driving circuit 123 for driving a plurality of light emission control lines (EML).

Also, the driving circuit can further include a controller 120 or the like which controls the first driving circuit 121, the second driving circuit 122, and the third driving circuit 123.

The display panel 110 can include an active area (A/A) in which an image is displayed and a non-active area (N/A) which is an edge area of the active area (A/A).

A plurality of sub-pixels (SP) is disposed in the active area (A/A) of the display panel 110.

In the non-active area (N/A) of the display panel 110, a pad to which the driving circuit (particularly, the first driving circuit 121) is electrically connected exists, and parts extending from the signal lines (DL, SCL, and EML) of the active area (A/A) or link lines which are electrically connected to signal lines (DL, SCL, and EML) of the active area (A/A) can be disposed. Also, in the non-active area (N/A), signal wirings (e.g., VGH wirings, VGL wirings, clock signal wirings, or the like) can be disposed which electrically connect the pad and the second and third driving circuits 122 and 123.

In the display panel 110, the plurality of data lines (DL) and the plurality of scan lines (SCL) can be disposed to intersect each other. For example, the plurality of scan lines (SCL) can be disposed in the row direction or the column direction. The plurality of data lines (DL) can be disposed in the column direction or the row direction.

Also, in the display panel 110, the plurality of data lines (DL) and the plurality of light emission control lines (EML) can be disposed to intersect each other. For example, the plurality of light emission control lines (EML) can be disposed in the row direction or the column direction. The plurality of data lines (DL) can be disposed in the column direction or the row direction. That is, the plurality of light emission control lines (EML) can be disposed in parallel with the plurality of scan lines (SCL).

Hereinafter, for ease of description, a description will be provided by assuming that the plurality of data lines (DL) are disposed in the column direction, and the plurality of scan lines (SCL) and the plurality of light emission control lines (EML) are disposed in the row direction.

In the display panel 110, other types of wirings can be disposed in addition to the plurality of data lines (DL), the plurality of scan lines (SCL), and the plurality of light emission control lines (EML).

The controller 120 can supply image data (DATA) to the first driving circuit 121.

Also, the controller 120 can supply various types of control signals (DCS and GCS) needed for driving the first through third driving circuits 121, 122, and 123, to control operation of the first through third driving circuits 121, 122, and 123.

The controller 120 starts scanning according to a timing implemented in each frame, converts input image data received from the outside according to a data signal format used in the first driving circuit 121, outputs the converted image data (DATA), and controls data driving at a proper time on the basis of the scanning.

The controller 120 can receive a timing signal, such as a vertical synchronization signal (Vsync), a horizontal synchronization signal (Hsync), an input data enable (DE) signal, a clock signal (CLK), and the like from the outside (e.g., a host system), can generate various types of control signals, and can output the control signals to the first through third driving circuits 121, 122, and 123, in order to control the first through third driving circuits 121, 122, and 123.

For example, in order to control the second driving circuit 122 and the third driving circuit 123, the controller 120 outputs various gate control signals (GCS) including a gate start pulse (GSP), a gate shift clock (GSC), a gate output enable (GOE) signal, and the like. Also, the controller 120 can output a gate voltage (VGH and VGL), a clock signal, and the like to the second driving circuit 122 and the third driving circuit 123.

Also, in order to control the first driving circuit 121, the controller 120 outputs various data control signals (DCS) including a source start pulse (SSP), a source sampling clock (SSC), a source output enable (SOE) signal, and the like.

The controller 120 can be a timing controller used in the general display technology, or a control device that includes the timing controller and further performs another control function.

The controller 120 can be implemented as an element separate from the first driving circuit 121, and can be implemented as an integrated circuit via integration with the first driving circuit 121.

The first driving circuit 121 can receive image data (DATA) from the controller 120, and can supply a data voltage to the plurality of data lines (DLs) to drive the plurality of data lines (DLs). Here, the first driving circuit 121 can be referred to as a data driving circuit or a source driving circuit.

The first driving circuit 121 can include a shift register, a latch circuit, a digital to analog converter (DAC), an output buffer, and the like.

The first driving circuit 121 can further include an analog to digital converter (ADC) depending on the situation.

The second driving circuit 122 can supply a scan signal of an ON-voltage or OFF-voltage to a plurality of scan lines (SCL) to drive the plurality of scan lines (SCL) according to the control of the controller 120. Here, the second driving circuit 122 can be referred to as a scan driving circuit or a first gate driving circuit.

The third driving circuit 123 can supply a light emission control signal of an ON-voltage or OFF-voltage to a plurality of light emission control lines (EML) to drive the plurality of scan lines (SCL) according to the control of the controller 120. Here, the third driving circuit 123 can be referred to as a light emission control line driving circuit or a second gate driving circuit.

The second driving circuit 122 and the third driving circuit 123 can include a shift register, a level shifter, and the like.

When a predetermined scan line (SCL) is opened by the second driving circuit 122, the first driving circuit 121 can convert image data (DATA) received from the controller 120 to a data voltage in the analog form, and provide the same to the plurality of data lines (DL).

The first driving circuit 121 can be located in only one portion (e.g., in the upper portion or in the lower portion) of the display panel 110. In some situations, the first driving circuit 121 can be located in both portions (in the upper portion and the lower portion) of the display panel 110 according to a driving scheme, a panel design scheme, or the like.

The second driving circuit 122 can be located in only one portion (e.g., in the left portion or in the right portion) of the display panel 110. In some situations, the second driving circuit 122 can be located in both portions (in the left portion and the right portion) of the display panel 110 according to a driving scheme, a panel design scheme, or the like.

The third driving circuit 123 can be located in only one portion (e.g., in the right portion or in the left portion) of the display panel 110. In some situations, the third driving circuit 122 can be located in both portions (in the left portion and the right portion) of the display panel 110 according to a driving scheme, a panel design scheme, or the like.

The first driving circuit 121 can be implemented to include at least one source driver integrated circuit (SDIC).

Each source driver integrated circuit (SDIC) can be connected to a bonding pad of the display panel 110 or can be directly disposed on the display panel 110 according to a tape automated bonding (TAB) scheme or a chip on glass (COG) scheme. Depending on various situations, each source driver integrated circuit (SDIC) can be disposed via integration with the display panel 110. Also, each source driver integrated circuit (SDIC) can be implemented according to a chip on film (COF) scheme. In this instance, each source driver integrated circuit (SDIC) can be mounted in a circuit film, and can be electrically connected to the data lines (DL) in the display panel 110 via the circuit film.

In the situation of the second driving circuit 122, one or more gate driver integrated circuits (GDIC) can be connected to a bonding pad of the display panel 110 according to a TAB scheme or a COG scheme. Also, the second driving circuit 122 can be implemented to be of a gate in panel (GIP) type, and can be directly disposed in the display panel 110. Also, the second driving circuit 122 can be implemented according to a chip on film (COF) scheme. In this instance, each gate driver integrated circuit (GDIC) included in the second driving circuit 122 can be mounted in the circuit film, and can be electrically connected to scan lines (SCL) corresponding to gate lines disposed in the display panel 110, via the circuit film.

In the situation of the third driving circuit 123, one or more gate driver integrated circuits (GDIC) can be connected to a bonding pad of the display panel 110 according to a TAB scheme or a COG scheme. Also, the third driving circuit 123 can be implemented to be of a gate in panel (GIP) type, and can be directly disposed in the display panel 110. Also, the third driving circuit 123 can be implemented according to a chip on film (COF) scheme. In this instance, each gate driver integrated circuit (GDIC) included in the third driving circuit 123 can be mounted in the circuit film, and can be electrically connected to light emission control lines (EML) corresponding to gate lines disposed in the display panel 110, via the circuit film.

The second driving circuit 122 and the third driving circuit 123 can be implemented separately, or can be implemented as an integrated entity.

From the perspective of a size, the display device 100 according to embodiments of the present disclosure can be implemented to be one of the various display devices, such as an extra-small display device, a small display device, a medium display device, a medium-large display device, an extra-large display device, and the like. Also, from the perspective of the type of product and a function, the display device 100 according to various embodiments of the present disclosure can be one of the various electronic devices such as a television, a computer monitor, a smart phone, a tablet, a mobile communication terminal, a wearable device, a smart watch, a lighting device and the like, or can be a display module included in various electronic devices.

Hereinafter, the structure of each sub-pixel (SP) disposed in the display panel 110 of the display device 100 according to embodiments of the present disclosure will be described with reference to FIGS. 2 and 3.

Figure 2:
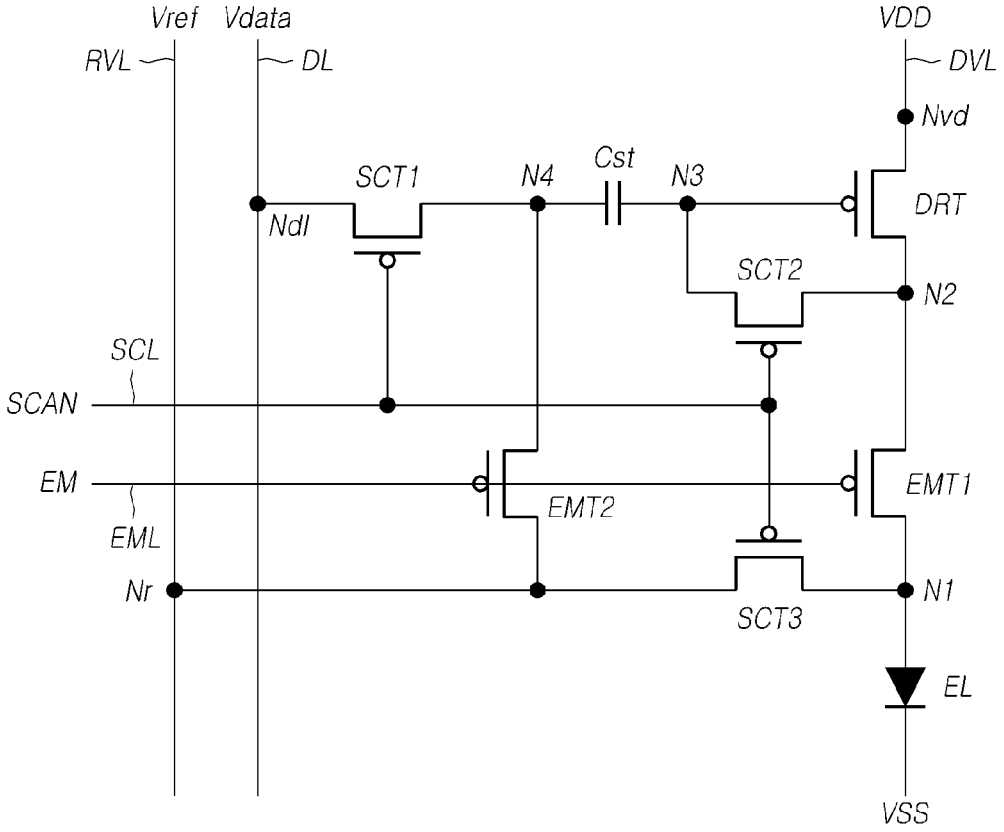
FIG. 2 is an equivalent circuit of a sub-pixel of a display device according to various embodiments of the present disclosure.
Figure 3:
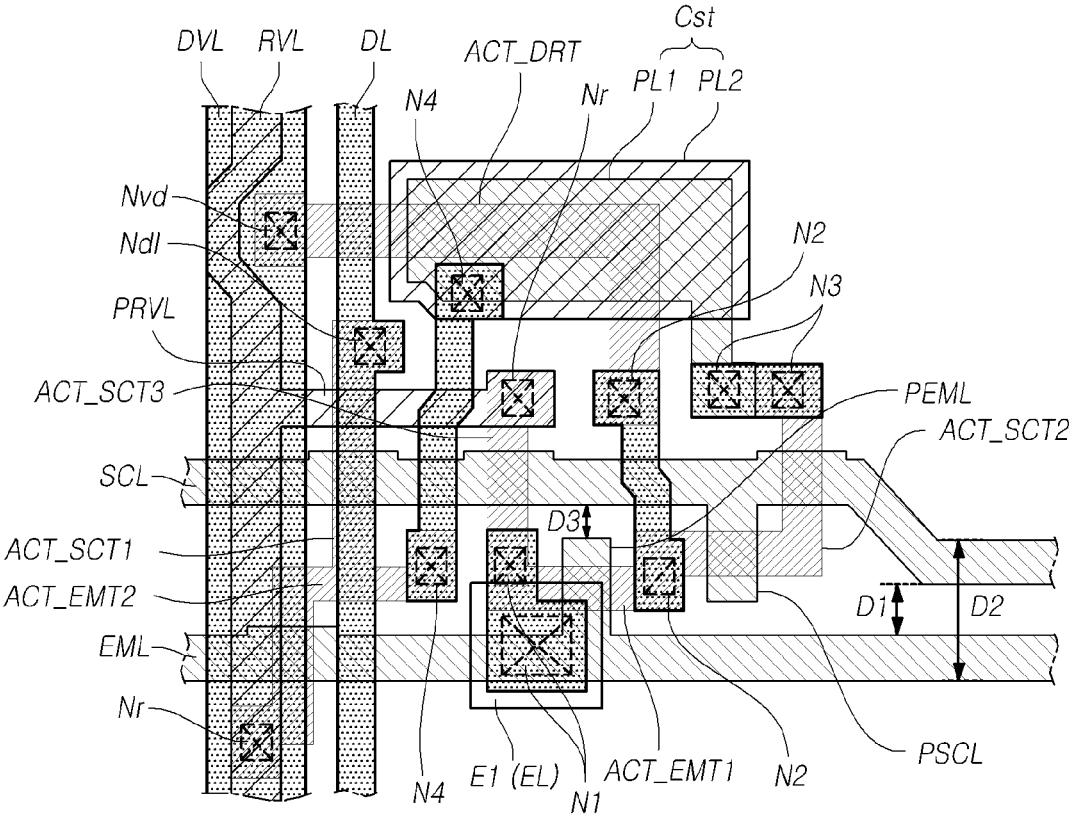
FIG. 3 is a plan view of a sub-pixel of a display device according to various embodiments of the present disclosure.

FIG. 2 is an equivalent circuit of a sub-pixel (SP) of the display device 100 according to embodiments of the present disclosure, and FIG. 3 is a plan view of a sub-pixel (SP) of the display device 100 according to embodiments of the present disclosure.

Referring to FIG. 2, each sub-pixel (SP) can be configured to include a light emitting device (EL), a driving transistor (DRT), a first scan transistor (SCT1), a second scan transistor (SCT2), a third scan transistor (SCT3), a first light emission control transistor (EMT1), a second light emission control transistor (EMT2), and a storage capacitor (Cst).

That is, each sub-pixel (SP) can be configured to include a light emitting device (EL), and six transistors (DRT, SCT1, SCT2, SCT3, EMT1, and EMT2) and one capacitor (Cst) for driving the light emitting device. Therefore, each sub-pixel (SP) can have a 6T (transistor) 1C (capacitor) structure.

Referring to FIGS. 2 and 3, each sub-pixel can include various electric nodes (N1, N2, N3, N4, Nvd, Ndl, and Nr) in order to configure a circuit of circuit elements (EL, DRT, SCT1, SCT2, SCT3, EMT1, EMT2, and Cst).

A light emitting device (EL) can be a light emitting device that emits a light of a predetermined color wavelength, or a white light including all colors. The light emitting device (EL) can include a first electrode (E1) (e.g., an anode electrode or a cathode electrode), a light emitting layer, a second electrode (e.g., a cathode electrode or an anode electrode), and the like.

The light emitting device (EL) can be electrically connected between a base voltage (VSS) and a first node (N1). Accordingly, the first electrode (E1) of the light emitting device (EL) can be electrically connected to the first node (N1), and the base voltage (VSS) can be provided to the second electrode of the light emitting device (EL).

The light emitting device (EL) can be, for example, an organic light emitting diode (OLED).

The first electrode (E1) of the light emitting device (EL) can be disposed to overlap some or all of the areas where the circuit elements (DRT, SCT1, SCT2, SCT3, EMT1, EMT2, and Cst) are disposed in the sub-pixel (SP). Unlike the above, the first electrode (E1) of the light emitting device (EL) can be disposed not to overlap some or all of the areas where the circuit elements (DRT, SCT1, SCT2, SCT3, EMT1, EMT2, and Cst) are disposed in the sub-pixel (SP).

The storage capacitor (Cst) can be electrically connected between a third node (N3) and a fourth node (N4). Here, a data voltage (Vdata) can be provided to the fourth node (N4) via the first scan transistor (ST1). The third node (N3) is a node connected to a gate node of the driving transistor (DRT), and a reference voltage (Vref) can be provided to the third node (N3).

The storage capacitor (Cst) can include a first plate (PL1) and a second plate (PL2). The first plate (PL1) can correspond to the third node (N3), can be electrically connected to the gate node of the driving transistor (DRT), and can be electrically connected to a drain node or a source node of the second scan transistor (SCT2). The second plate (PL2) can correspond to the fourth node (N4), can be electrically connected to a drain node or a source node of the first scan transistor (ST1), and can be electrically connected to a drain node or a source node of the second light emission control transistor (EMT2).

For example, in the storage capacitor (Cst), the first plate (PL1) is formed of the same substance (e.g., a gate substance) as those of a scan line (SCL) and a light emission control line (EML). The second plate (PL2) is formed of the same substance as that of a reference voltage line (RVL).

The driving transistor (DRT) is a transistor that supplies a driving current to a light emitting device (EL) to drive the light emitting device (EL).

The driving transistor (DRT) can be electrically connected between a driving voltage line (DVL) and the second node (N2). Particularly, the source node or the drain node of the driving transistor (DRT) can be electrically connected to the driving voltage line (DVL) at a driving voltage node (Nvd). The drain node or source node of the driving transistor (DRT) corresponds to the second node (N2), can be electrically connected to the source node or drain node of the first light emission control transistor (EMT1), and can be electrically connected to the source node or drain node of the second scan transistor (SCT2). The gate node of the driving transistor (DRT) can correspond to the third node (N3), can be electrically connected to the drain node or source node of the second scan transistor (SCT2), and can be electrically connected to the first plate (PL1) of the storage capacitor (Cst).

An active layer (ACT_DRT) disposed between the source node and the drain node of the driving transistor (DRT) can be disposed between the driving voltage node (Nvd) and the second node (N2). The active layer (ACT_DRT) of the driving transistor (DRT) can overlap the first plate (PL1) of the storage capacitor (Cst) corresponding to the third node (N3).

The source node (source electrode) and drain node (drain electrode) of the driving transistor (DRT) can be formed of the same substance as those of the data line (DL), the driving voltage line (DLV), and the like.

The first light emission control transistor (EMT1) can control an electric connection between the driving transistor (DRT) and the light emitting device (EL).

The first light emission control transistor (EMT1) can be electrically connected between the first node (N1) and the second node (N2).

The source node or drain node of the first light emission control transistor (EMT1) can correspond to the first node (N1). The drain node or the source node of the first light emission control transistor (EMT1) can correspond to the second node (N2). The gate node of the first light emission control transistor (EMT1) can be electrically connected to a light emission control line (EML). Here, the light emission control line (EML) can be a signal line that delivers a light emission control signal (EM) output from the third driving circuit 123.

Here, the first node (N1) is a node that is electrically connected to the source node or drain node of the first light emission control transistor (EMT1), the first electrode (E1) of the light emitting device (EL), and the drain node or source node of the third scan transistor (SCT3). The second node (N2) is a node that is electrically connected to the drain node or source node of the driving transistor (DRT), the source node or drain node of the second scan transistor (SCT2), and the drain node or source node of the first light emission control transistor (EMT1).

The active layer (ACT_EMT1) disposed between the source node and the drain node of the first light emission control transistor (EMT1) can overlap the light emission control line (EML), and can be disposed between the first node (N1) and the second node (N2).

The second light emission control transistor (EMT2) can control an electrical connection between the fourth node (N4) and the reference voltage line (RVL). The second light emission control transistor (EMT2) can be electrically connected between the fourth node (N4) and the reference voltage line (RVL).

The source node or drain node of the second light emission control transistor (EMT2) can correspond to the reference voltage node (Nr), and can be electrically connected to the reference voltage line (RVL). The drain node or the source node of the second light emission control transistor (EMT2) can correspond to the fourth node (N4). The gate node of the second light emission control transistor (EMT2) can be electrically connected to the light emission control line (EML). Here, the light emission control line (EML) can be a signal line that delivers a light emission control signal (EM) output from the third driving circuit 123.

The gate node of the second light emission control transistor (EMT2) and the gate node of the first light emission control transistor (EMT1) can be electrically connected to the same light emission control line.

Here, the reference voltage node (Nr) can be a point on the reference voltage line (RVL), or can be a pattern of an electrical connection with the reference voltage line (RVL). The fourth node (N4) is a node that is electrically connected to the drain node or source node of the second light emission control transistor (EMT2), the drain node or source node of the first scan transistor (SCT1), and the second plate (PL2) of the storage capacitor (Cst).

Depending on a driving timing, a data voltage (Vdata) or a reference voltage (Vref) can be provided to the fourth node (N4). The second light emission control transistor (EMT2) can control whether to provide a reference voltage (Vref) to the fourth node according to a driving timing.

Also, if there is a driving timing period in which a data voltage (Vdata) needs to be provided to the fourth node (N4) and a reference voltage (Vref) needs to be provided to the reference voltage node (Nr), the second light emission control transistor (EMT2) is turned off during the driving timing period, so that the reference voltage (Vref) provided to the reference voltage node (Nr) is not provided to the fourth node (N4) to which the data voltage (Vdata) needs to be provided. That is, since the second light emission control transistor (EMT2) is turned off, two types of voltages (Vref and Vdata) are not mixed in the fourth node (N4). In other words, the second light emission control transistor (EMT2) is turned off and thus, the fourth node (N4) and the reference voltage node (Nr) can be electrically disconnected from each other.

In other words, the second light emission control transistor (EMT2) can prevent a short-circuit (short) between the data voltage (Vdata) and the reference voltage (Vref). That is, the second light emission control transistor (EMT2) can prevent a short-circuit (short) between the data line (DL) and the reference voltage line (RVL).

The active layer (ACT_EMT2) disposed between the source node and the drain node of the second light emission control transistor (EMT2) can overlap the light emission control line (EML), and can be disposed between the fourth node (N4) and the reference voltage node (Nr).

The first scan transistor (SCT1) can deliver a data voltage (Vdata) to the second plate (PL2) of the storage capacitor (Cst) corresponding to the fourth node (N4). Therefore, the first scan transistor (SCT1) can be electrically connected between the fourth node (N4) and a corresponding data line (DL).

The source node or drain node of the first scan transistor (SCT1) can be electrically connected to the data line (DL) at the data voltage node (Nd1). The drain node or source node of the first scan transistor (SCT1) can correspond to the fourth node (N4), and can be electrically connected to the second plate (PL2) of the storage capacitor (Cst). The gate node of the first scan transistor (SCT1) can be electrically connected to a corresponding scan line (SCL) and a scan signal (SCAN) can be provided.

The active layer (ACT_SCT1) disposed between the source node and the drain node of the first scan transistor (SCT1) can overlap the scan line (SCL), and can be disposed between the fourth node (N4) and the data voltage node (Nd1).

The second scan transistor (SCT2) can control an electrical connection between the second node (N2) and the third node (N3). Therefore, the second scan transistor (SCT2) can be electrically connected between the second node (N2) and the third node (N3).

The source node or drain node of the second scan transistor (SCT2) can correspond to the second node (N2), and a reference voltage (Vref) can be provided according to a driving timing. The drain node or source node of the second scan transistor (SCT2) can correspond to the third node (N3), and can be electrically connected to the first plate (PL1) of the storage capacitor (Cst). The gate node of the second scan transistor (SCT2) can be electrically connected to a corresponding scan line (SCL) and a scan signal (SCAN) can be provided. According to a driving timing, the second scan transistor (SCT2) is turned on, and the reference voltage (Vref) can be provided to the third node corresponding to the first plate (PL1) of the storage capacitor (Cst).

The active layer (ACT_SCT2) disposed between the source node and the drain node of the second scan transistor (SCT2) can overlap the scan line (SCL), and can be disposed between the second node (N2) and the third node (N3). The active layer (ACT_SCT2) of the second scan transistor (SCT2) can overlap the scan line (SCL), and can additionally overlap a protrusion (PSCL) of the scan line (SCL).

The third scan transistor (SCT3) can control an electrical connection between the first node (N1) corresponding to the first electrode (E1) of the light emitting device (EL) and the reference voltage line (RVL). Therefore, the third scan transistor (SCT3) can be electrically connected between the first node (N1) and the corresponding reference voltage line (RVL).

The source node or drain node of the third scan transistor (SCT3) can be electrically connected to the reference voltage line (RVL) at the reference voltage node (Nr). The drain node or source node of the third scan transistor (SCT3) can be electrically connected to the first electrode (E1) of the light emitting device (EL) and the source node or drain node of the first light emission control transistor (EMT1). The gate node of the third scan transistor (SCT3) can be electrically connected to the corresponding scan line (SCL) and a scan signal (SCAN) can be provided.

The active layer (ACT_SCT3) disposed between the source node and the drain node of the third scan transistor (SCT3) can overlap the scan line (SCL), and can be disposed between the first node (N1) and the reference voltage node (Nr).

Referring to FIGS. 2 and 3, the gate node of the first scan transistor (SCT1), the gate node of the second scan transistor (SCT2), and the gate node of the third scan transistor (SCT3) can be electrically connected to a single scan line (SCL) in common. That is, only one scan line (SCL) is used in order to drive a single sub-pixel row. The aperture ratio of the display panel 110 can be increased to that extent. Although the gate node of the first scan transistor (SCT1), the gate node of the second scan transistor (SCT2), and the gate node of the third scan transistor (SCT3) are connected to one scan line (SCL) in common, a special driving timing operation is needed in order to normally operate a sub-pixel. This will be described in detail with reference to FIGS. 6 to 10.

The gate node of the first light emission control transistor (EMT1) and the gate node of the second light emission control transistor (EMT2) can be electrically connected to a single light emission control line (EML). That is, only one light emission control line (EML) is used in order to drive a single sub-pixel row. The aperture ratio of the display panel 110 can be increased to that extent. Although the gate node of the first light emission control transistor (EMT1) and the gate node of the second light emission control transistor (EMT2) are connected to a single light emission control line (EML) in common, a special driving timing operation is needed in order to normally operate a sub-pixel. This will be described in detail with reference to FIGS. 6 to 10.

In the above-described circuit of a sub-pixel (SP), each of six transistors (DRT, SCT1, SCT2, SCT3, EMT1, and EMT2) can be an N-type transistor or a P-type transistor.

The storage capacitor (Cst) can be an external capacitor that is designed intentionally in the third node (N3) and the fourth node (N4), as opposed to a parasitic capacitor (e.g., Cgs, Cgd, Cds) which is an internal capacitor existing between two of the source node, drain node, and gate node of a transistor.

The structure of a sub-pixel (SP) illustrated in FIGS. 2 and 3 is merely an example, and can further include one or more transistors or can further include one or more capacitors, depending on the situation. Alternatively, a plurality of sub-pixels can be in the same structure, and some of the plurality of sub-pixels can be in different structures. For example, a dummy sub-pixel for special purpose can exist in an edge area of an active area (A/A). The dummy sub-pixel can be designed to include no light emitting device (EL) or to include a different number of transistors or capacitors, and can have a structure different from the structure of a sub-pixel (a sub-pixel having the structure of FIG. 2) existing in the active area (A/A).

Referring to FIG. 3, the driving voltage line (DVL) and the reference voltage line (RVL) can disposed in different layers separated by an insulating layer. A part or the whole of the driving voltage line (DVL) can overlap the reference voltage line (RVL).

As described above, the driving voltage line (DVL) and the reference voltage line (RVL) are disposed in different layers and overlap each other, thereby increasing the aperture ratio of the display panel 110.

Referring to FIG. 3, the protrusion (PRVL) of the reference voltage line (RVL) and the data line (DL) intersect and overlap each other.

Particularly, the reference voltage line (RVL) and the data line (DL) can be disposed in the same direction. For example, when the reference voltage line (RVL) and the data line (DL) are disposed in the column direction, the protrusion (PRVL) of the reference voltage line can protrude in the row direction from the reference voltage line (RVL), and can traverse the data line (DL) disposed in the column direction.

The protrusion (PRVL) of the reference voltage line (RVL) and the active layer (ACT_SCT1) of the first scan transistor (SCT1) can intersect and can partially overlap each other.

A part of the active layer (ACT_SCT1) of the first scan transistor (SCT1) and the data line (DL) can overlap each other.

The protrusion (PEML) of the light emission control line (EML) can be disposed between the first node (N1) and the second node (N2).

As described above, the storage capacitor (Cst) can include the first plate (N3) and the second plate (N4).

For example, the first plate (N3) of the storage capacitor (Cst) can be located in the same substance layer as that of the light emission control line (EML) or scan line (SCL), and can be disposed in the same substance layer as that of one of the reference voltage line (RVL), the driving voltage line (DVL), and the data line (DL).

A part of the active layer (ACT_DRT) of the driving transistor (DRT) can overlap the storage capacitor (Cst).

A part of the active layer (ACT_DRT) of the driving transistor (DRT) and the data line (DL) can intersect and overlap.

Five transistors (SCT1, SCT2, SCT3, EMT1, and EMT2) among the six transistors (DRT, EMT1, EMT2, SCT1, SCT2, and SCT3) can be transistors of which gate nodes are to be provided with a gate signal (SCAN and EM).

If gate lines (SCL and EML) are separately configured to supply a gate signal (SCAN and EM) to the gate nodes of the five transistors (SCT1, SCT2, SCT3, EMT1, and EMT2), the aperture ratio of the display panel 110 can be dramatically decreased.

If the gate lines (SCL and EML) for supplying a gate signal (SCAN and EM) to the gate nodes of the five transistors (SCT1, SCT2, SCT3, EMT1, and EMT2) are disposed within a limited area, intervals between the gate lines (SCL and EML) should be narrowed or the width of each of the gate lines (SCL and EML) should be narrowed. In this instance, the resistance of the gate lines (SCL and EML) may be increased, the load between the gate lines (SCL and EML) may be increased, and a signal transfer performance via the gate lines (SCL and EML) may deteriorate or signal interference may occur between the gate lines (SCL and EML).

According to the structure of a sub-pixel (SP) as illustrated in FIGS. 2 and 3, the first through third scan transistors (SCT1, SCT2, and SCT3) can be provided with a scan signal (SCAN) from the same scan line (SCL) in common, and the first and second light emission control transistors (EMT1 and EMT2) can be provided with a light emission control signal (EM) from the same light emission control line (EML) in common, and thus, the number of the scan lines (SCL) and the light emission control lines (EML) can be reduced. Accordingly, the aperture ratio can be increased.

The first through third scan transistors (SCT1, SCT2, and SCT3) can be provided with a scan signal (SCAN) from the same scan line (SCL) in common, and the first and second light emission control transistors (EMT1 and EMT2) can be provided with a light emission control signal (EM) from the same light emission control line (EML) in common, and thus, the width (D2) in the row direction that the gate lines (SCL and EML) occupy to provide a gate signal (SCAN and EM) to the gate nodes of the five transistors (SCT1, SCT2, SCT3, EMT1, and EMT2) can be dramatically decreased.

However, there is a room for increasing the width of each scan line (SCL) and light emission control line (EML), and the interval (D1 and D3) between the scan line (SCL) and the light emission control line (SML) can be increased. Accordingly, the resistance of each of the scan line (SCL) and the light emission control line (EML) can be reduced and the load between the scan line (SCL) and the light emission control line (SML) can be reduced. Also, the signal transfer performance via the scan line (SCL) and the light emission control line (EML) can be improved, and the signal interference between the gate lines (SCL and EML) can be reduced or removed.

The above-described effects of the structure of a sub-pixel (SP) as illustrated in FIGS. 2 and 3 can be significantly shown in a transparent display.

There can be situation in which at least one of the first through third scan transistors (SCT1, SCT2, and SCT3) needs to be turned on, and at least one of the first and second light emission control transistors (EMT1 and EMT2) needs to be turned on. However, there is a driving timing period in which a reference voltage (Vref) should be provided to the fourth node (N4). For example, a driving timing period (operation S10 of FIG. 6) can exist, in which a reference voltage (Vref) needs to be provided to the fourth node (N4), and the first scan transistor (SCT1) is inevitably turned on due to the common structure of the scan line (SCL).

During the driving timing period, the second light emission control transistor (EMT2) cannot be turned off. Therefore, although the structure of a sub-pixel (SP) of FIG. 2 is used, that is, the second light emission control transistor (EMT2) is used, a short-circuit between the data voltage (Vdata) and the reference voltage (Vref) at the fourth node (N4) may not be prevented. In other words, although the second light emission control transistor (EMT2) is used, this may not prevent a short-circuit (short) between the data line (DL) and the reference voltage line (RVL).

Therefore, various embodiments of the present disclosure can further provide a circuit configuration and a method therefor, which can decrease an aperture ratio via the structure that connects one scan line (SCL) to the gate nodes of the first through third scan transistors (SCT1, SCT2, and SCT3) in common, and can prevent a short-circuit between the data voltage (Vdata) and the reference voltage (Vref). This will be described in detail with reference to FIGS. 4 to 10.

Figure 4:
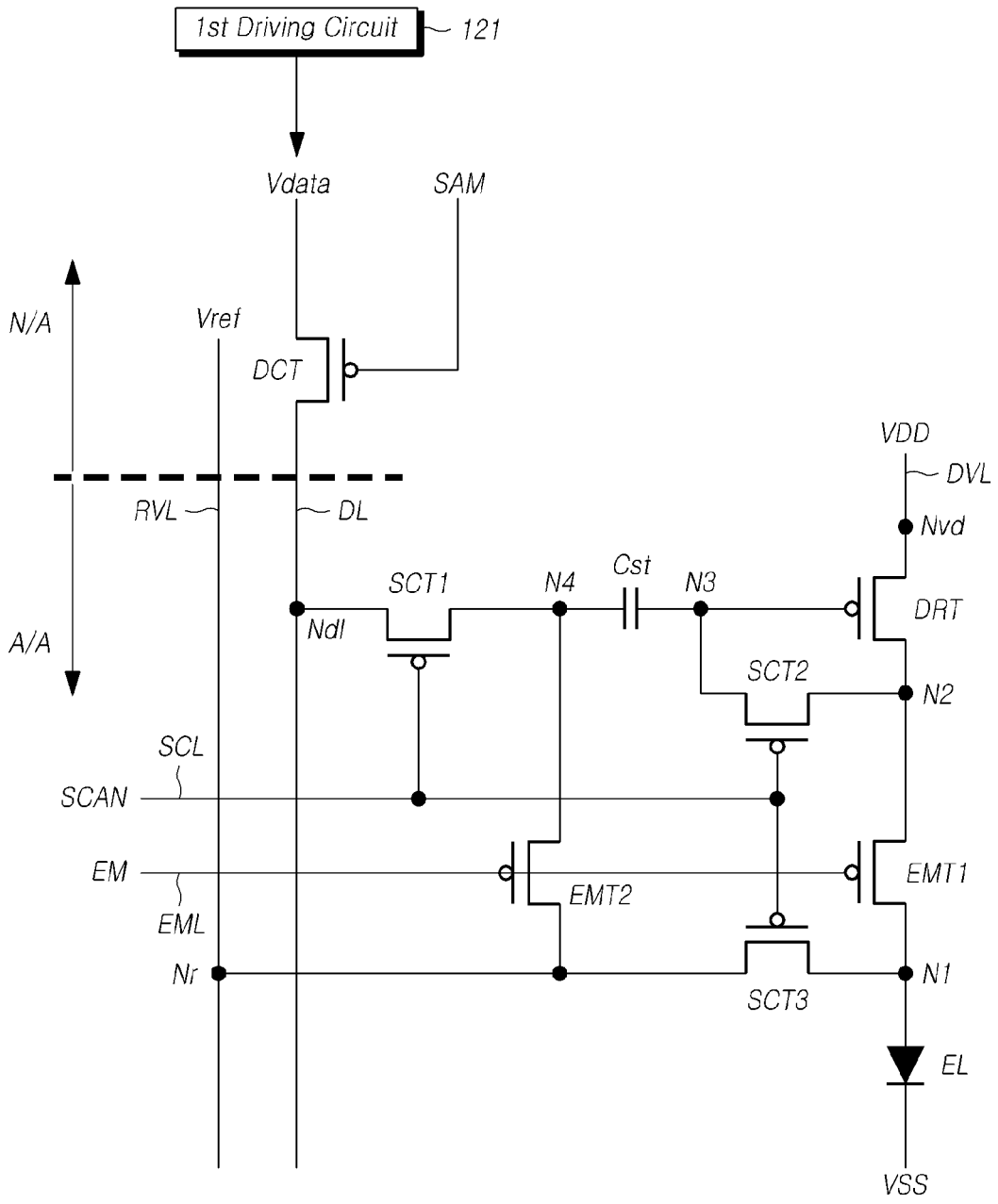
FIG. 4 is an equivalent circuit for describing a compensation circuit of a display device according to various embodiments of the present disclosure.
Figure 5:
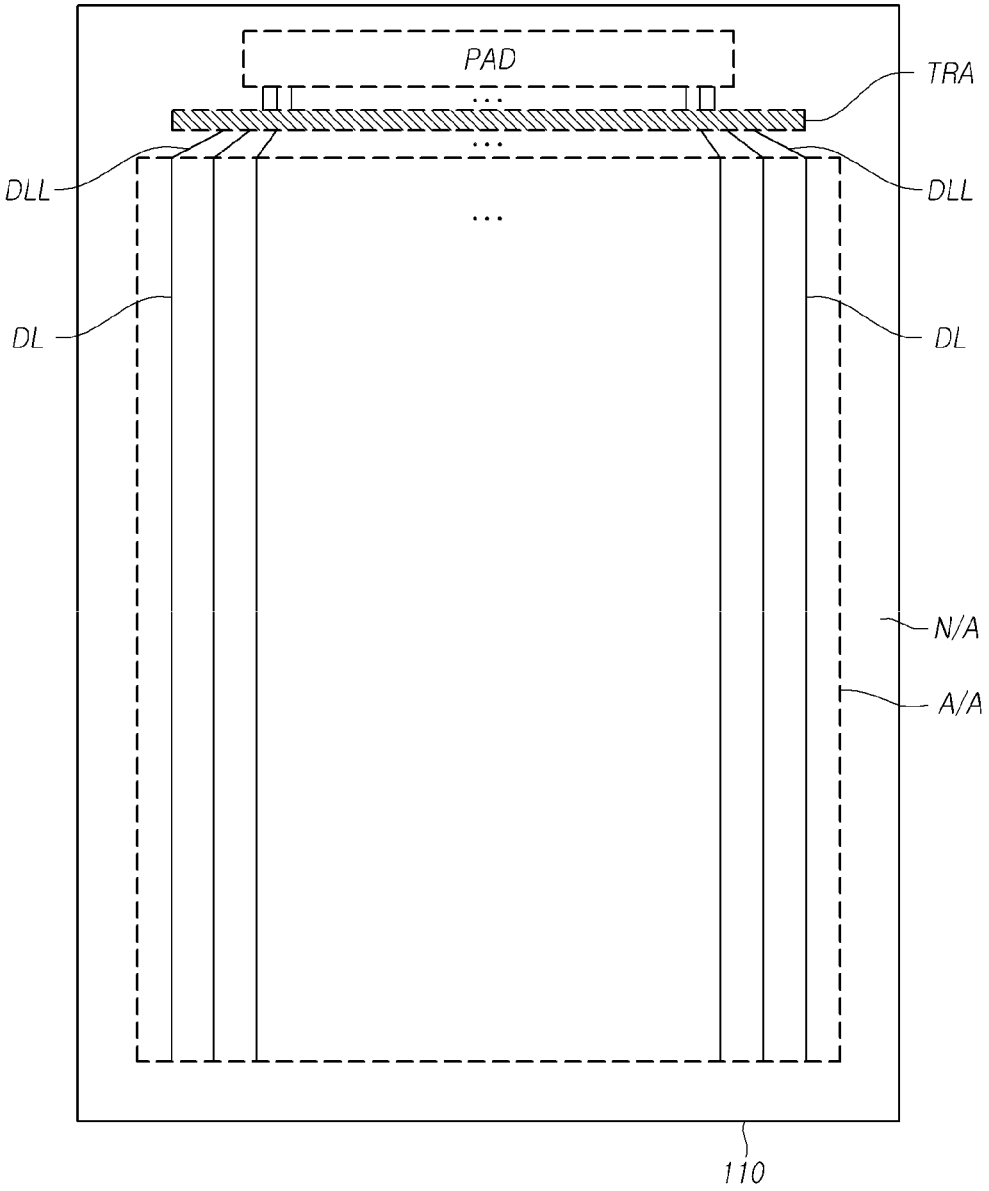
FIG. 5 is a diagram illustrating a location in which a data control transistor, included in a compensation circuit of a display device, is disposed according to various embodiments of the present disclosure.

FIG. 4 is an equivalent circuit for describing a compensation circuit of the display device 100 according to various embodiments of the present disclosure. FIG. 5 is a diagram illustrating a location in which a data control transistor (DCT), included in a compensation circuit of the display device 100, is disposed according to various embodiments of the present disclosure.

The display device 100 according to various embodiments of the disclosure can include: the display panel 110 in which a plurality of data lines (DL), a plurality of scan lines (SCL), and a plurality of light emission control lines (EML) are disposed, and a plurality of sub-pixels are arranged; a first driving circuit 121 for driving the plurality of data lines (DL); the second driving circuit 122 for driving the plurality of scan lines (SCL); and a third driving circuit 123 for driving a plurality of light emission control lines (EML).

The display panel 110 can include an active area (A/A) in which an image is displayed and a non-active area (N/A) which is an edge area of the active area (A/A).

Referring to FIG. 4, each of the plurality of sub-pixels (SP) can include: a light emitting device (EL) electrically connected between a base voltage (VSS) and a first node (N1); a driving transistor (DRT) electrically connected between a driving voltage line (DVL) and a second node (N2); a storage capacitor (Cst) electrically connected between a third node (N3) and a fourth node (N4); a first light emission control transistor (EMT1) electrically connected between the first node (N1) and the second node (N2); a second light emission control transistor (EMT2) electrically connected between the fourth node (N4) and a reference voltage line (RVL); a first scan transistor (SCT1) electrically connected between the fourth node (N4) and a corresponding data line (DL); a second scan transistor (SCT2) electrically connected between the second node (N2) and the third node (N3); and a third scan transistor (SCT3) electrically connected between the first node (N1) and the corresponding reference voltage line (RVL).

Referring to FIG. 4, the gate node of the first scan transistor (SCT1), the gate node of the second scan transistor (SCT2), and the gate node of the third scan transistor (SCT3) can be electrically connected to a single scan line (SCL).

Referring to FIG. 4, the gate node of the first light emission control transistor (EMT1) and the gate node of the second light emission control transistor (EMT2) can be electrically connected to a single light emission control line (EML).

Referring to FIG. 4, the compensation circuit of the display device 100 according to various embodiments of the present disclosure is a circuit which compensates for a change or a deviation of a characteristic value (e.g., a threshold value or mobility) of a driving transistor (DRT) in a sub-pixel, and can include a sub-pixel (SP) which is disposed in an active area (A/A) and has a 6T1C structure, and a data control transistor (DCT) which is disposed in a non-active area (N/A) and/or an active area (A/A).

Referring to FIG. 4, a data control transistor (DTC) can be disposed to correspond to each of the plurality of data lines (DL). That is, one data control transistor (DCT) can be disposed for each data line (DL).

Referring to FIG. 4, a data control transistor (DCT) can control whether to connect a corresponding data line (DL) and the first driving circuit 121 according to an operation step of a corresponding sub-pixel.

Referring to FIG. 5, a data control transistor (DCT) can be disposed in a non-active area (N/A) of the display panel 110 to which the first driving circuit 121 is electrically connected.

Particularly, a pad (PAD) to which the first driving circuit 121 is electrically connected can exist in the non-active area (N/A). The first driving circuit 121 is of a chip on film (COF) type or a chip on glass (COG) type, and can be electrically connected to the pad (PAD).

A transistor area (TRA) can exist between the pad (PAD) and the active area (A/A) in which a plurality of data lines (DL) is disposed.

The transistor area (TRA) can be included in the non-active area (N/A).

The plurality of data control transistors (DCT) can be disposed in the transistor area (TRA).

A part that extends from a data line (DL) or a part that is electrically connected to a data line (DL) is referred to as a data link line (DLL).

The drain node or source node of a data control transistor (DCT) is electrically connected to a data link line (DLL), and the source node or drain node of the data control transistor (DCT) can be electrically connected to a data output unit (e.g., an output buffer) of the first driving circuit 121.

During a first period (e.g., S10 of FIG. 6), a reference voltage (Vref) is provided to the first plate (PL1) and the second plate (PL2) of the storage capacitor (Cst), and a data control transistor (DCT) is turned off, whereby the second plate (PL2) of the storage capacitor (Cst) and the first driving circuit 121 can be electrically disconnected from each other.

Here, in the storage capacitor (Cst), the first plate (PL1) can correspond to the third node (N3) and the second plate (PL2) can correspond to the fourth node (N4).

During a second period (S20 of FIG. 6) after the first period (e.g., S10 of FIG. 6), as the data control transistor (DCT) is turned on, the second plate (PL2) of the storage capacitor (Cst) and the first driving circuit 121 can be electrically connected.

Referring to FIG. 4, the data control transistor (DCT) is controlled by a sampling signal (SAM), and can control whether to connect the first driving circuit 121 and the data line (DL).

The sampling signal (SAM) is a type of gate signal, and can be provided by one of the controller 120, the first driving circuit 121, the second driving circuit 122, the third driving circuit 123, and the like.

Also, a signal line for delivering the sampling signal (SAM) is connected to the gate node of the data control transistor (DCT), and the signal line can be disposed in the non-active area (N/A).

Figure 6:
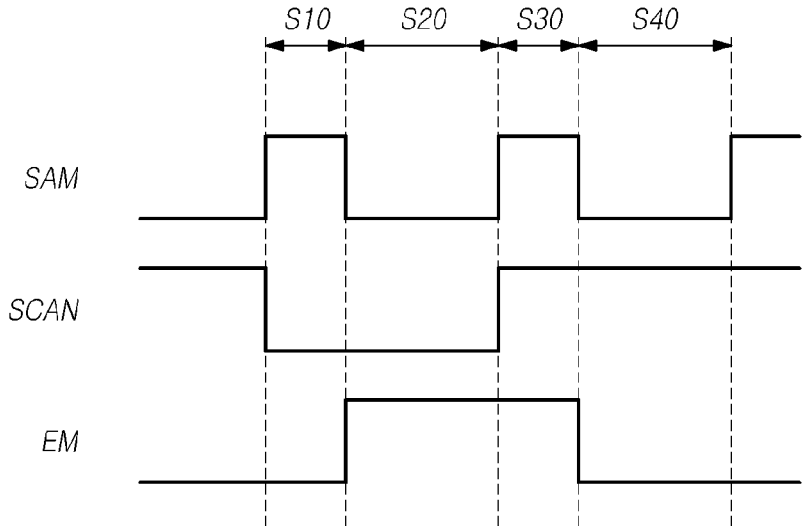
FIG. 6 is a diagram illustrating a driving timing for a compensation circuit of a display device according to embodiments of the present disclosure.

FIG. 6 is a diagram illustrating a driving timing for the compensation circuit of the display device 100 according to embodiments of the present disclosure. FIGS. 7 to 10 are diagrams illustrating a state for each driving step of the compensation circuit of the display device 100 according to various embodiments of the present disclosure. Six transistors (DRT, SCT1, SCT2, EMT1, EMT2, and EMT3) and a data control transistor (DCT) all are p-type transistors.

Referring to FIG. 6, the compensation circuit of the display device 100 according to various embodiments of the present disclosure can be implemented via four operations S10, S20, S30, and S40.

Referring to FIG. 6, among the four operations S10, S20, S30, and S40 of the compensation circuit of the display device 100 according to embodiments of the present disclosure, operation S10 is an initialization operation that initializes a second node (N2), a third node (N3), a fourth node (N4), and the like with a reference voltage Vref. Operation S20 is a sampling operation that provides a data voltage (Vdata) to the fourth node (N4). Operation S30 is a pre-light emission operation in which the six transistors DRT, SCT1, SCT2, EMT1, EMT2, and EMT3 and the data control transistor DCT all are turned off. Operation S40 is a light emission operation in which a light emitting device (EL) emits light.

Figure 7:
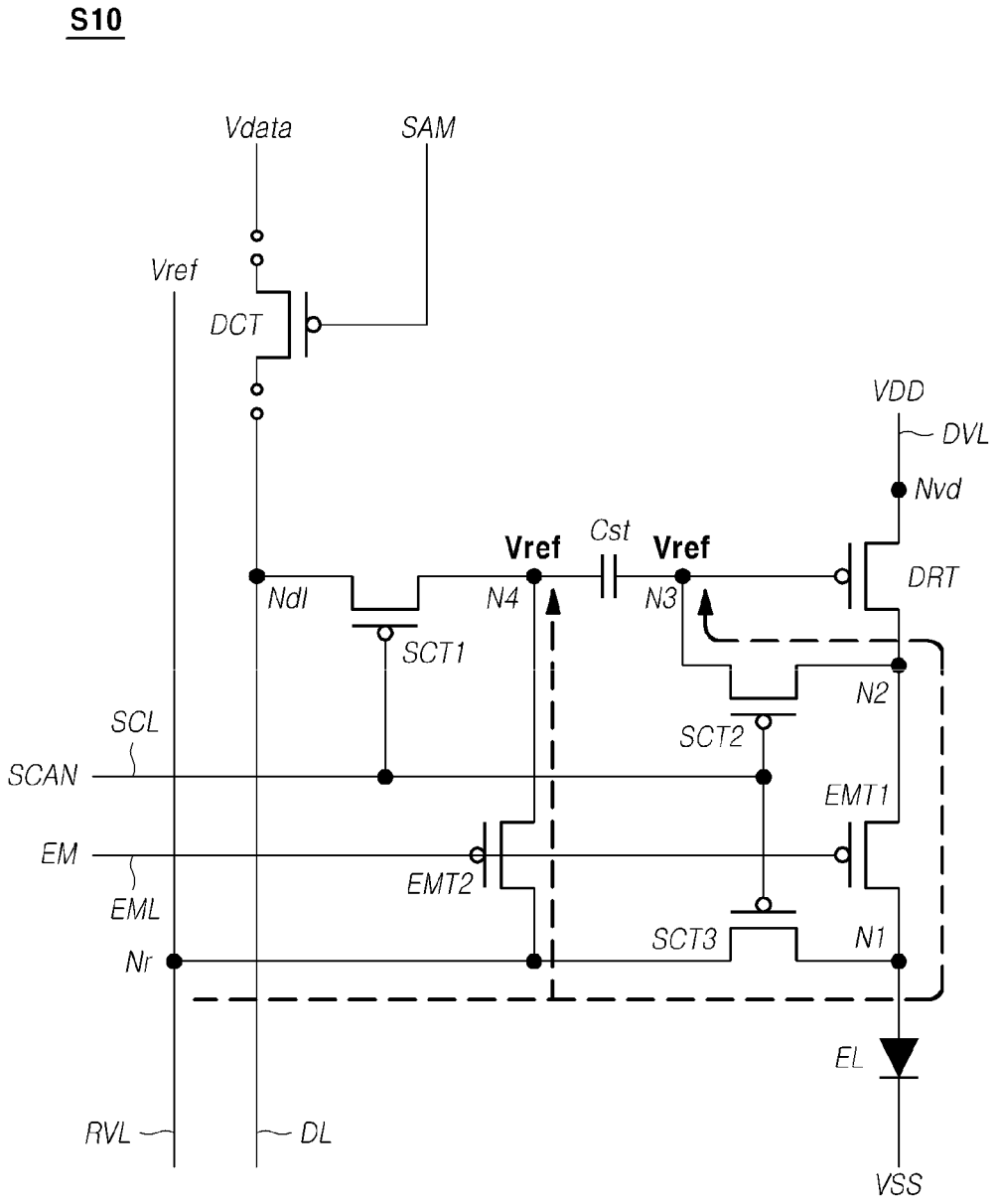
FIGS. 7 to 10 are diagrams illustrating a state for each driving step of a compensation circuit of a display device according to various embodiments of the present disclosure.

Referring to FIGS. 6 and 7, during operation S10, a scan signal (SCAN) is in a turn-on voltage level. A light emission control signal (EM) is in a turn-on voltage level. A sampling signal (SAM) is in a turn-off voltage level.

Accordingly, during a part or the whole of operation S10, the first scan transistor (SCT1), the second scan transistor (SCT2), and the third scan transistor (SCT3) are in the turned-on state. The first light emission control transistor (EMT1) and the second light emission control transistor (EMT2) are in the turned-on state, and the data control transistor (DCT) is in the turned-off state.

During a part or the whole of operation S10, the data control transistor (DCT) is turned off and the first driving circuit 121 and a data line (DL) are open. That is, since the data control transistor (DCT) is turned off, the first driving circuit 121 and the data line DL are electrically disconnected from each other.

During operation S10, the data control transistor (DCT) is turned off and six transistors (DRT, SCT1, SCT2, EMT1, EMT2, and EMT3) in a sub-pixel are turned on, whereby a reference voltage (Vref) can be provided to the second node (N2), the third node (N3), and the fourth node (N4).

During operation S10, the reference voltage (Vref) can be provided to the fourth node (N4) via the second light emission control transistor (EMT2). Here, the fourth node (N4) can correspond to the second plate (PL2) of the storage capacitor (Cst).

During operation S10, the reference voltage (Vref) can be provided to the second node (N2) via the third scan transistor (SCT3) and the first light emission control transistor (EMT1), and the reference voltage (Vref) provided to the second node (N2) can be provided to the third node (N3) via the second scan transistor (SCT2). Here, the third node (N3) can correspond to the first plate (PL1) of the storage capacitor (Cst).

As described above, during a part or the whole of operation S10, the data control transistor DCT is turned off, and the first driving circuit 121 and a data line (DL) are electrically disconnected from each other. Therefore, although the first scan transistor ST1 is turned on, a data voltage (Vdata) is not provided to the fourth node (N4) to which the reference voltage has been provided.

In other words, during the driving timing period (operation S10) in which a reference voltage (Vref) is to be provided to the fourth node (N4) and thus the second light emission control transistor (EMT2) may not be turned off and the first scan transistor (SCT1) is inevitably turned on due to the common structure of the scan line (SCL), provision of the data voltage (Vdata) to the fourth node (N4) to which the reference voltage Vref has been provided can be prevented. That is, during operation S10, a short-circuit between the data voltage (Vdata) and the reference voltage (Vref) at the fourth node N4 can be prevented. A short-circuit (short) between a data line (DL) and a reference voltage line (RVL) can be prevented.

During operation S10, the reference voltage (Vref) provided to the fourth node (N4) may be provided to the data line (DL) via the first scan transistor (SCT1) which is turned on.

Figure 8:
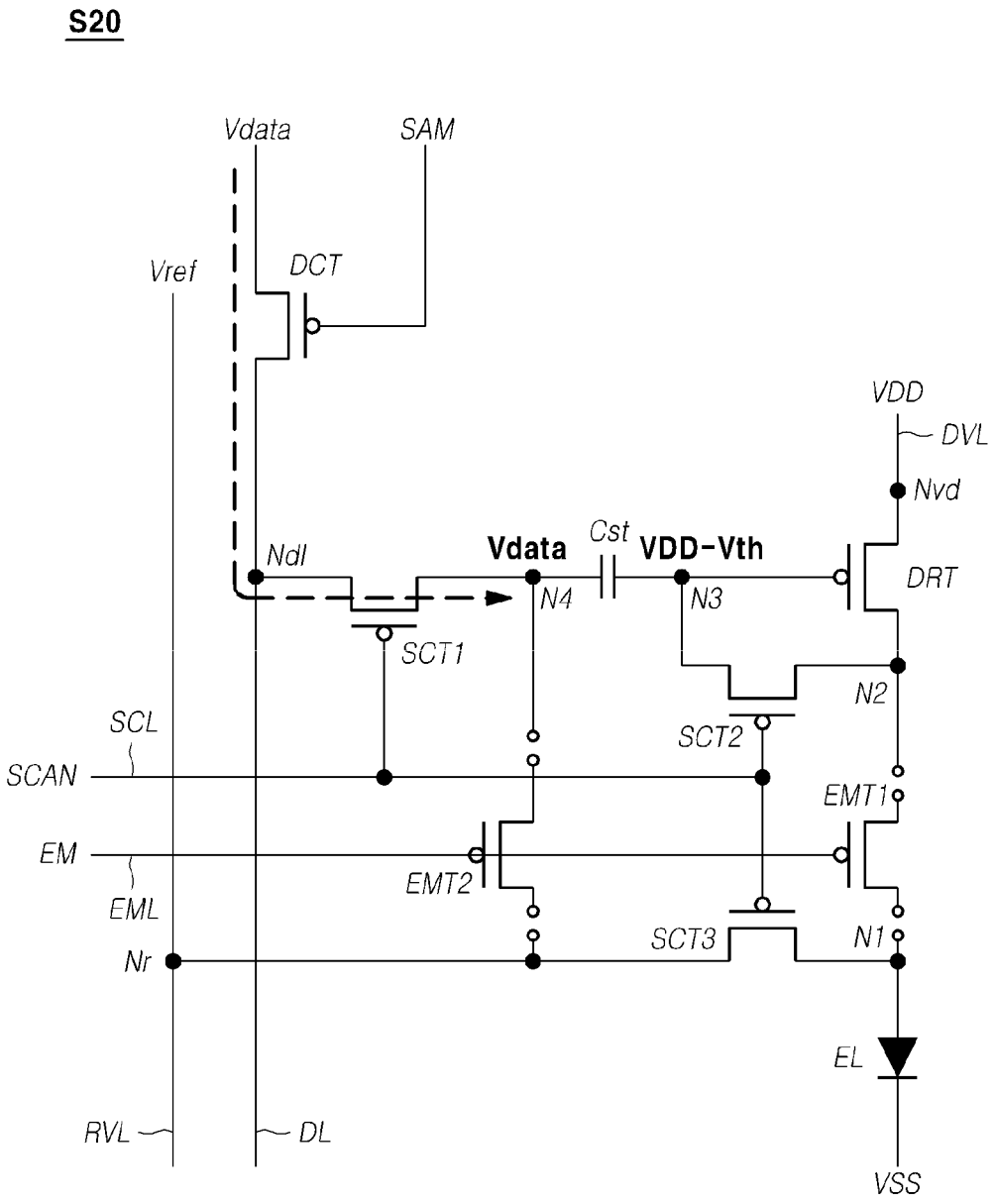

Referring to FIGS. 6 and 8, during a part or the whole of operation S20, a scan signal SCAN is in a turn-on voltage level, and a light emission control signal EM is in a turn-off voltage level.

Accordingly, during a part or the whole of operation S20, the first scan transistor SCT1, the second scan transistor SCT2, and the third scan transistor SCT3 are in the turned-on state. The first light emission control transistor EMT1 and the second light emission control transistor EMT2 are in the turned-off state.

During a part or the whole of operation S20, a sampling signal SAM can be in a turn-on voltage level. Accordingly, the data control transistor (DCT) is turned on.

Since the data control transistor (DCT) is turned on, the first driving circuit 121 and the data line (DL) are electrically connected with each other. Therefore, a data voltage (Vdata) output from the first driving circuit 121 is supplied to a data line (DL) via the data control transistor (DCT) which is turned on.

The data voltage (Vdata) supplied to the data line (DL) can be provided to the fourth node (N4) via the first scan transistor (SCT1) which is turned on. The second light emission control transistor (EMT2) can be in the turned-off state. Therefore, the voltage state of the fourth node (N4) can be changed from the reference voltage (Vref) to the data voltage (Vdata).

During a part or the whole of operation S20, the first light emission control transistor (EMT1) is turned off, and the second node (N2) and the third node (N3) can float.

The voltage of the third node (N3) which electrically floats can correspond to the difference (VDD-Vth) between a driving voltage (VDD) and the threshold voltage (Vth) of the driving transistor (DRT). That is, during operation S20, compensation is performed in association with the threshold voltage (Vth) of the driving transistor DRT. Here, "VDD-Vth" can be a voltage higher than the reference voltage (Vref).

Referring to FIGS. 6, 7, and 8, from the perspective of an electrical connection between the second plate (PL2) of the storage capacitor (Cst) and the first driving circuit 121, during the first period (operation S10), a reference voltage (Vref) is provided to the first plate (PL1) and the second plate (PL2) of the storage capacitor (Cst), the data control transistor (DCT) is turned off, and the second plate (PL2) of the storage capacitor (Cst) and the first driving circuit 121 can be electrically disconnected from each other. During the second period (operations S20) after the first period (operation S10), the data control transistor (DCT) is turned on, and the second plate (PL2) of the storage capacitor (Cst) and the first driving circuit 121 can be electrically connected.

Figure 9:
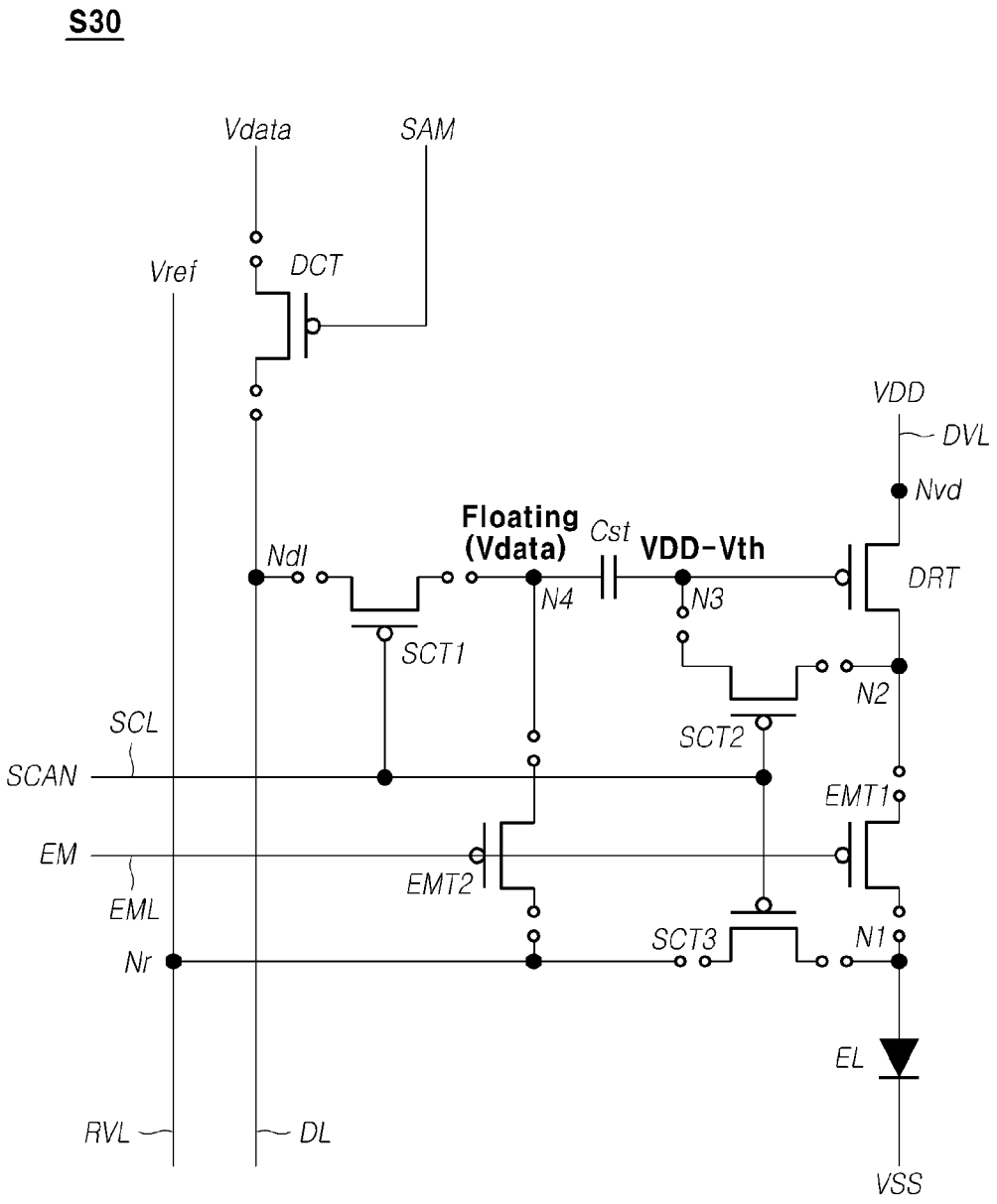

Referring to FIGS. 6 and 9, during a part or the whole of operation S30, a scan signal SCAN is in a turn-off voltage level, and a light emission control signal EM is in a turn-off voltage level.

Accordingly, during a part or the whole of operation S30, the first scan transistor (SCT1), the second scan transistor (SCT2), and the third scan transistor (SCT3) are in the turned-off state. The first light emission control transistor (EMT1) and the second light emission control transistor (EMT2) are in the turned-off state.

During a part or the whole of operation S30, a sampling signal (SAM) can be in a turn-off voltage level. Accordingly, the data control transistor (DCT) can be turned off.

Therefore, during a part or the whole of operation S30, the fourth node (N4) can float. The fourth node (N4) that floats can have a data voltage (Vdata) or a voltage similar thereto.

During a part or the whole of operation S30, the third node (N3) can electrically float, and the voltage of the third node (N3) can correspond to the difference (VDD-Vth) between the driving voltage (VDD) and the threshold voltage (Vth) of the driving transistor (DRT). That is, during operation S30, compensation can be performed in association with the threshold voltage (Vth) of the driving transistor (DRT).

Figure 10:
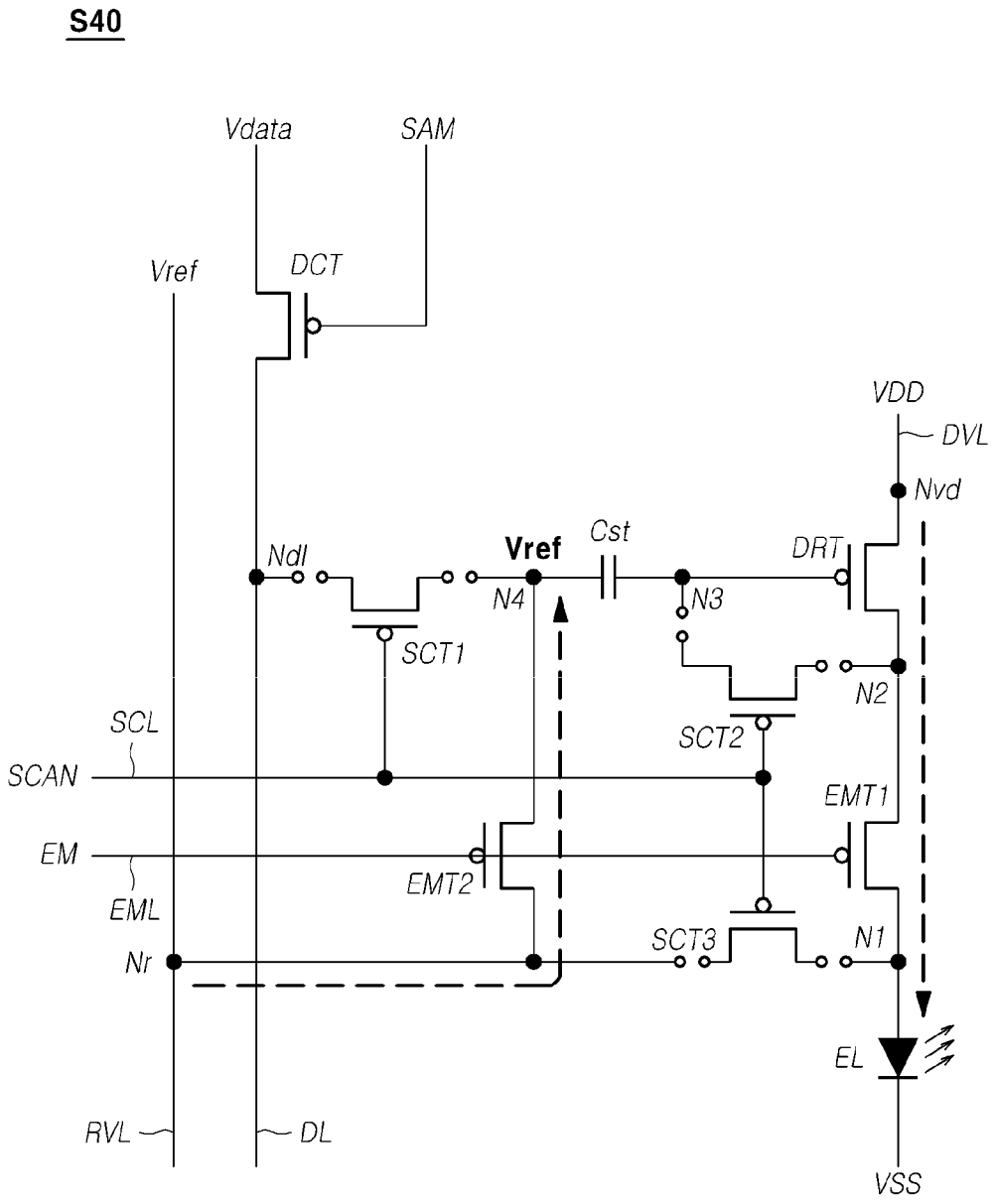

Referring to FIGS. 6 and 10, during a part or the whole of operation S40, a scan signal (SCAN) is in a turn-off voltage level, and a light emission control signal (EM) is in a turn-on voltage level.

Accordingly, the first scan transistor (SCT1), the second scan transistor (SCT2), and the third scan transistor (SCT3) are in the turned-off state. The first light emission control transistor (EMT1) and the second light emission control transistor (EMT2) are in the turned-on state.

During a part or the whole of operation S40, a sampling signal (SAM) can be a turn-on voltage level. Accordingly, the data control transistor (DCT) can be turned on. This is for a driving operation (operation S20 which is the sampling operation) of a sub-pixel disposed in another sub-pixel row.

During operation S40, the fourth node (N4) is changed from the data voltage (Vdata) or a voltage similar thereto to the reference voltage Vref. To correspond to a change in the voltage of the fourth node (N4), the voltage of the third node (N3) can change. That is, during operation S40, the voltage of the fourth node (N4) decreases to the reference voltage (Vref), and the voltage of the third node (N3) can also decrease by that extent.

Therefore, the driving transistor (DRT) is in a state of being capable of supplying a current to the light emitting device (EL).

During operation S40, since the first light emission control transistor (EMT1) is turned on, a current is supplied from the driving transistor (DRT) to the light emitting device (EL), and the light emitting device (EL) emits light.

Figure 11:
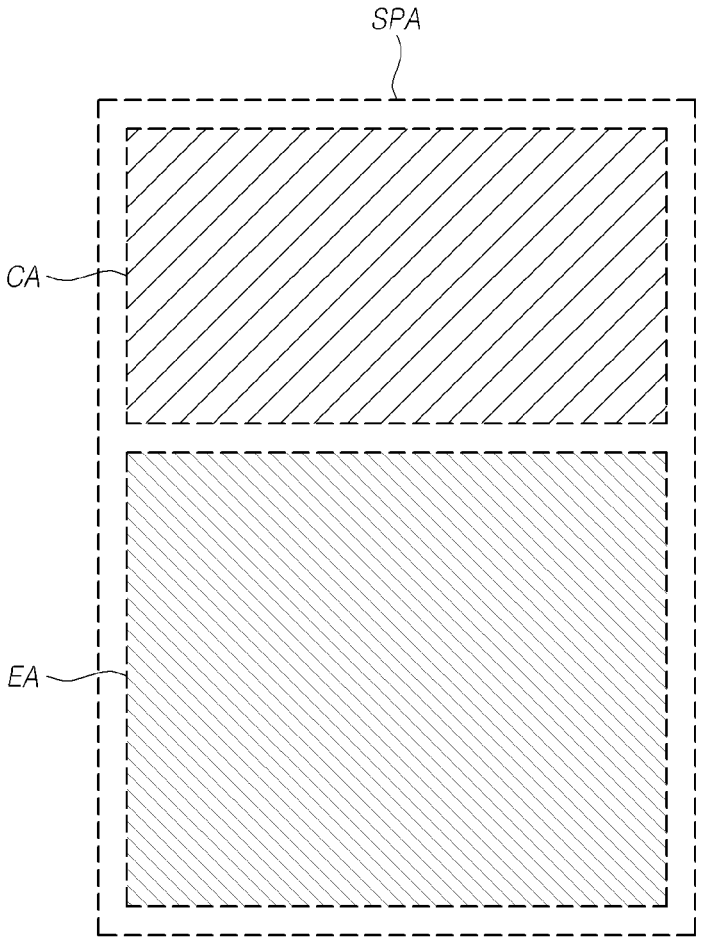
FIG. 11 is a diagram illustrating a single sub-pixel area in a display panel of a display device according to embodiments of the present disclosure.
Figure 12:
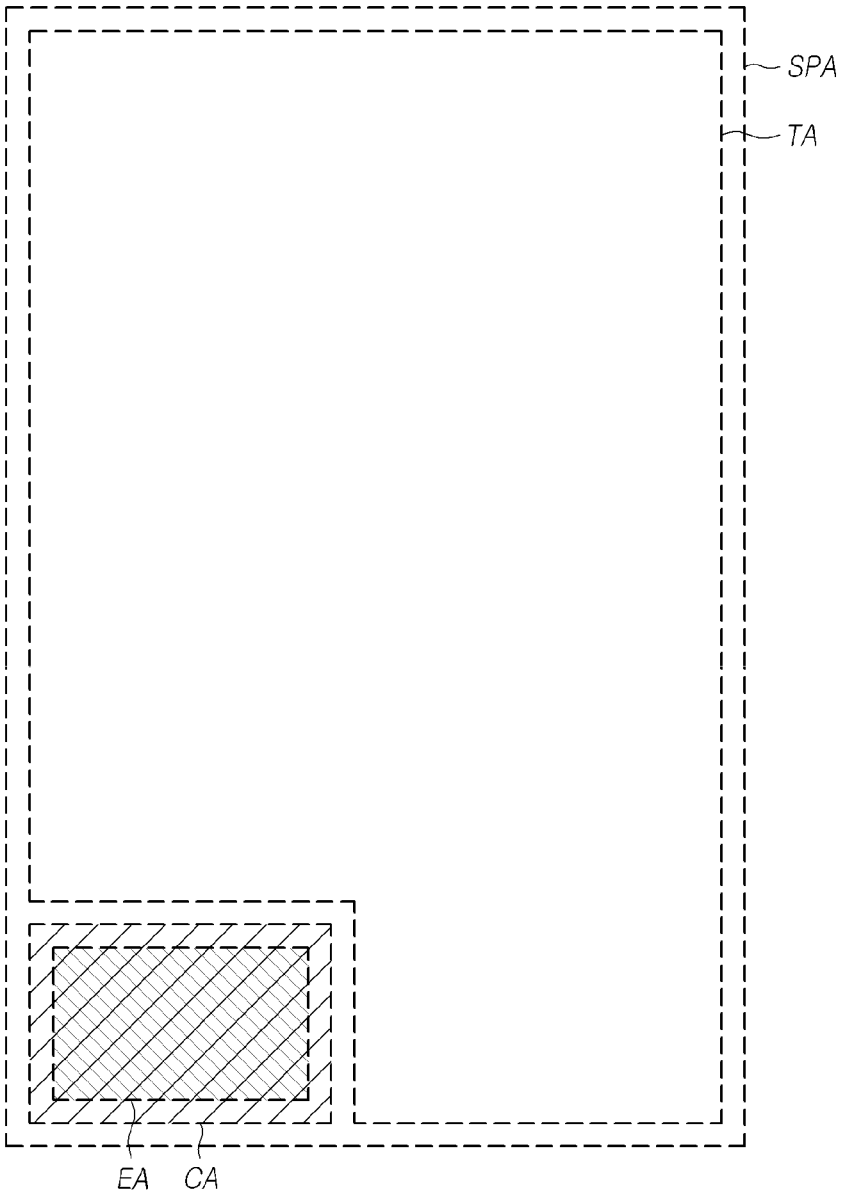
FIG. 12 is a diagram illustrating a single sub-pixel area when a display panel of a display device is a transparent display panel according to embodiments of the present disclosure.

FIG. 11 is a diagram illustrating a sub-pixel area (SPA) of a single sub-pixel (SP) in the display panel 110 of the display device 100 according to embodiments of the present disclosure. FIG. 12 is a diagram illustrating a sub-pixel area (SPA) of a sub-pixel (SP) when the display panel 110 of the display device 100 according to embodiments of the present disclosure is a transparent display panel.

Referring to FIGS. 11 and 12, the sub-pixel area (SPA) of a single sub-pixel (SP) can include a circuit area (CA) in which a driving transistor (DRT), first to third scan transistors (SCT1 to SCT3), first and second light emission control transistors (EMT1 and EMT2), and a storage capacitor (Cst) are disposed, and a light emission area (emission area (EA)) that emits light from a light emitting device (EL).

Referring to FIGS. 11 and 12, a first electrode (E1, e.g., an anode electrode) of a light emitting device (EL) can be disposed in the light emission area (EA). The first electrode (E1) of the light emitting device (EL) can be electrically connected to the source node or drain node of the first light emission control transistor (EMT1) at the first node N1 in the circuit area (CA).

Referring to FIG. 11, the first electrode (E1) of the light emitting device (EL) can be disposed to not overlap the circuit area (CA), excluding a part for contact with the first node (N1) in the circuit area (CA). In this instance, the light emission area (EA) and the circuit area (CA) do not overlap, or may only overlap slightly or partially.

The display panel 110 in which the light emission area (EA) and the circuit area (CA) do not overlap due to the disposition of the first electrode (E1) can be applied to a non-transparent display.

Unlike the above, as illustrated in FIG. 12, the first electrode (E1) of the light emitting device (EL) can be disposed such that most of the first electrode (E1) can overlap the circuit area (CA). In this instance, as illustrated in FIG. 12, the light emission area (EA) and the circuit area (CA) mostly overlap, and the display panel 110 can be applied to a transparent display.

Therefore, as illustrated in FIG. 12, each sub-pixel area (SPA) can further include a transparent area (TA). Here, the transparent area (TA) can be an edge area of the circuit area (CA) and the light emission area (EA).

The transparent area (TA) can be an area in which an opaque pattern such as an opaque electrode, signal wirings, various substance layers, or the like does not exist, or can be an area in which only a pattern having a transparency greater than a predetermined level exists.

The ratio of the transparent area (TA) to the sub-pixel area (SPA) is a main factor of determining the transparency of the display panel 110.

In order to increase the ratio of the transparent area (TA) to the sub-pixel area (SPA), it is important to decrease the size of the circuit area (CA) where opaque electrodes and wirings exist.

Due to various design factors (scan line sharing, light emission control line sharing, signal wiring superposition, and the like) which can increase the aperture ratio, and the size of the circuit area (CA) can be reduced. Accordingly, the size of the transparent area (TA) can be extended and enlarged, and the transparency of the display panel 110 can be increased.

Figure 13:
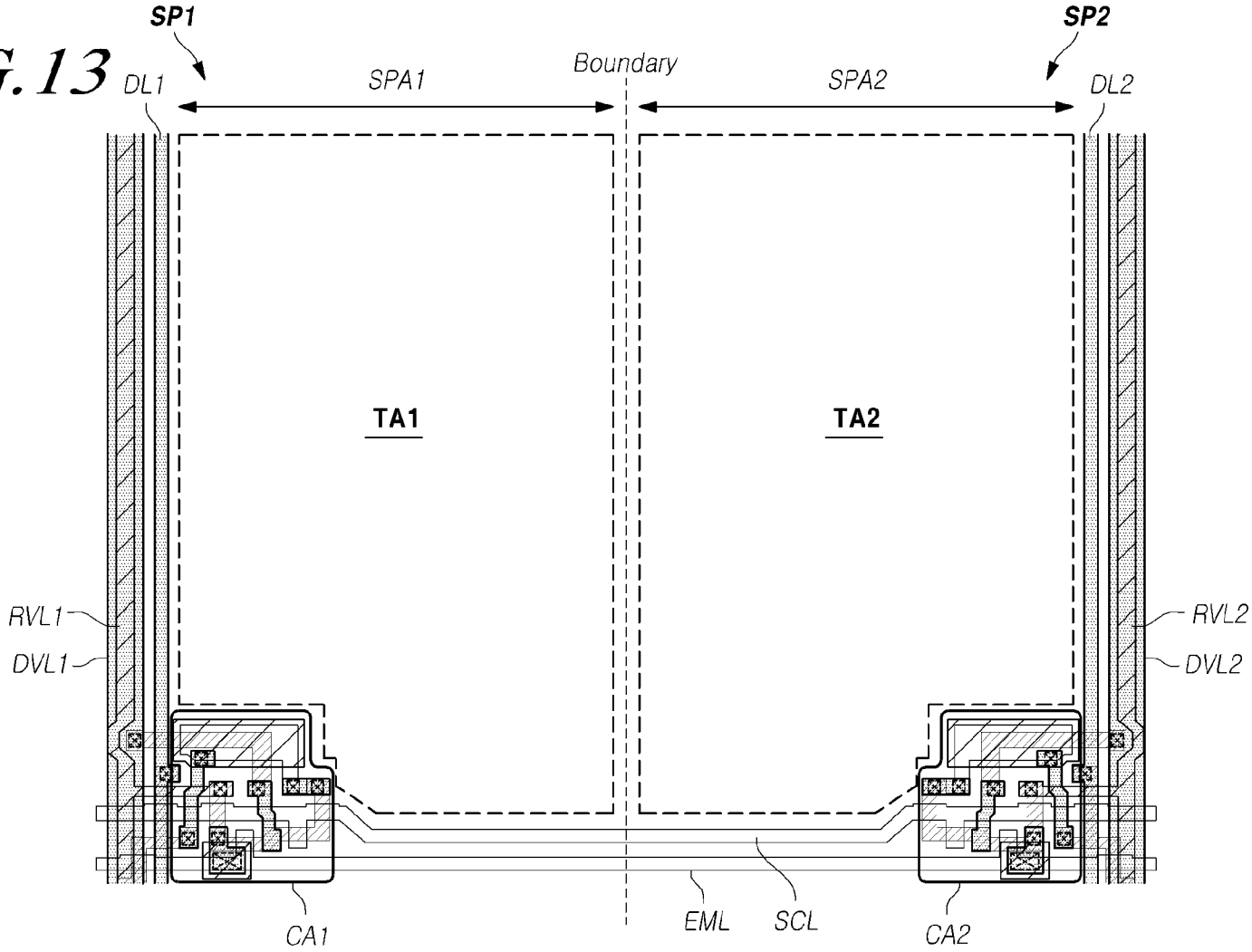
FIG. 13 is a plan view of two sub-pixel areas adjacent in the row direction, when a display panel of a display device is a transparent display panel according to various embodiments of the present disclosure.

FIG. 13 is a plan view of areas (SPA1 and SPA2) of two sub-pixels (SP1 and SP2) which are adjacent in the row direction when the display panel 110 of the display device 100 according to embodiments of the present disclosure is a transparent display panel.

Referring to FIG. 13, a plurality of sub-pixels (SP) can include a first sub-pixel (SP1) and a second sub-pixel (SP2) which are adjacent to each other in the row direction.

Referring to FIG. 13, in the areas (SPA1 and SPA2) in which the first sub-pixel (SP1) and the second sub-pixel (SP2) are disposed, signal wirings (DL1, RVL1, DVL1, DL2, RVL2, and DVL2) in the column direction and signal wirings (SCL and EML) in the row direction can be disposed.

In the boundary area between the first sub-pixel (SP1) and the second sub-pixel (SP2), signal wirings (DL1, RVL1, DVL1, DL2, RVL2, and DVL2) in the column direction are not be disposed.

The signal wirings (DL1, RVL1, and DVL1) in the column direction can be disposed in the opposite side of a side corresponding to the boundary with the second sub-pixel (SP2) among both sides of the first sub-pixel (SP1).

The signal wirings (DL2, RVL2, and DVL2) in the column direction can be disposed in the opposite side of a side corresponding to the boundary with the first sub-pixel (SP1) among both sides of the second sub-pixel (SP2).

Among signal wirings (DL1, RVL1, DVL1, DL2, RVL2, and DVL2) in the column direction, a first driving voltage line (DVL1) and a first reference voltage line (RVL1) can overlap each other, and a second driving voltage line (DVL2) and a second reference voltage line (RVL2) can overlap each other.

Also, in the circuit area (CA1 and CA2) of each of the first sub-pixel (SP1) and the second sub-pixel (SP2), three scan transistors (SCT1, SCT2, and SCT3) and two light emission control transistors (EMT1 and EMT2) are disposed, but a single scan line (SCL) and a single light emission control line (EML) are disposed as signal wirings in the row direction.

Also, the driving voltage lines (DVL1 and DVL2) and the reference voltage lines (RVL1, RVL2) which correspond to common voltage lines can be shared by adjacent sub-pixels.

For example, when sub-pixels are adjacent in the order of the first sub-pixel (SP1), the second sub-pixel (SP2), and the third sub-pixel (SP3), the second driving voltage line (DVL2) can supply a driving voltage (VDD) to the second sub-pixel (SP2) and the third sub-pixel (SP3) in common. The second reference voltage line (RVL2) can supply a reference voltage (Vref) to the second sub-pixel (SP2) and the third sub-pixel (SP3) in common.

As described above, the size of the circuit area (CA1 and CA2) can be reduced, the common signal wirings (DVL and RVL) in the column direction are shared by adjacent sub-pixels, and signal wirings in the column direction are not be disposed in the boundary of the two sub-pixel areas (SPA1 and SPA2). Also, the number of signal wirings (SCL and EML) in the row direction can be reduced.

Therefore, the transparent area (TA1, TA2) can be extended in the row direction and the column direction, and the transparency of the display panel 110 can be significantly improved.

Referring to FIG. 12, the plurality of sub-pixels (SP) includes a first sub-pixel (SP1) and a second sub-pixel (SP2) adjacent to each other.

Each of the first sub-pixel (SP1) and the second sub-pixel (SP2) includes a light emission area (EA), a circuit area (CA), and a transparent area (TA).

The transparent area (TA) does not overlap the light emission area (EA) and the circuit area (CA). A part or a whole of the light emission area (EA) overlaps with a part or a whole of the circuit area (CA).

The light emitting device (EL), the driving transistor (DRT), the scan transistor (SCT1, SCT2, SCT3), and the storage capacitor (Cst) are disposed in the circuit area (CA). The light emission control transistor (EMT1, EMT2) are disposed in the circuit area (CA).

Referring to FIG. 13, the transparent area (TA1) of the first sub-pixel (SP1) and the transparent area (TA2) of the second sub-pixel (SP2) are integrated into one transparent area.

Referring to FIG. 13, a plurality of signal wirings (DL1, RVL1, DVL1) in the column direction connected to the first sub-pixel (SP1) is disposed on opposite sides of a side adjacent to a boundary between the first sub-pixel (SP1) and the second sub-pixel (SP2) among both sides of the first sub-pixel (SP1).

A plurality of signal wirings (DL2, RVL2, DVL2) in the column direction connected to the second sub-pixel (SP2) is disposed on opposite sides of a side adjacent to a boundary between the first sub-pixel (SP1) and the second sub-pixel (SP2) among both sides of the second sub-pixel (SP2).

At least one signal wiring (SCL, EML) in a row direction connected to the first sub-pixel (SP1) and the second sub-pixel (SP2) is disposed across or adjacent to the circuit area (CA1, CA2).

As described above, according to embodiments of the present disclosure, the display device 100 and the display panel 110 which have a high aperture ratio can be provided.

Further, according to embodiments, the present disclosure can provide the display device 100 and the display panel 110 which prevent a short-circuit between a data voltage (Vdata) and a reference voltage (Vref) having different voltage values during driving.

Further, according to embodiments of the present disclosure, the present disclosure can provide the display device 100 and the display panel 110 which increase an aperture ratio via integration of scan lines and prevent a short-circuit between a data voltage (Vdata) and a reference voltage (Vref) during driving.

Further, according to embodiments of the present disclosure, the present disclosure can provide the display device 100 and the display panel 110 having a high transparency.

Further, according to various embodiments of the present disclosure, the present disclosure can provide the display device 100 and the display panel 110 which enlarge and extend a transparent area (TA) via a superposition structure of different types of signal wirings (DVL, RVL, and the like).

Further, according to various embodiments of the present disclosure, the present disclosure can provide the display device 100 and the display panel 110 which enlarge and extend a transparent area (TA) by designing the display device 100 and the display panel 110 such that common signal wirings (DVL and RVL) in the column direction (or the row direction) are shared by adjacent sub-pixels, and signal wirings (DVL, RVL, DL, and the like) in the column direction (or the row direction) are not disposed in the boundary between two adjacent sub-pixel areas among four sub-pixel areas.

Further, according to embodiments of the present disclosure, the present disclosure can provide the display device 100 and the display panel 110 which extend a transparent area (TA) by decreasing the number of signal wirings (EML and SCL) in the row direction (or column direction).

The above description and the accompanying drawings provide an example of the technical idea of the present disclosure for illustrative purposes only. Those having ordinary knowledge in the technical field, to which the present disclosure pertains, will appreciate that various modifications and changes in form, such as combination, separation, substitution, and change of a configuration, are possible without departing from the features of the present disclosure. Therefore, the embodiments disclosed in the present disclosure are intended to illustrate the scope of the technical idea of the present disclosure, and the scope of the present disclosure is not limited by the embodiment. The scope of the present disclosure shall be construed on the basis of the accompanying claims in such a manner that all of the technical ideas included within the scope equivalent to the claims belong to the present disclosure.

What is claimed is:

1. A display device, comprising:

a display panel including a plurality of data lines, a plurality of scan lines, a plurality of light emission control lines, and a plurality of sub-pixels;

a first driving circuit configured to drive the plurality of data lines;

a second driving circuit configured to drive the plurality of scan lines; and a third driving circuit configured to drive the plurality of light emission control lines, wherein the display panel includes an active area in which an image is displayed and a non-active area which is an edge area of the active area, wherein each of the plurality of sub-pixels include:

a light emitting device electrically connected between a base voltage and a first node;

a driving transistor electrically connected between a driving voltage line and a second node;

a storage capacitor electrically connected between a third node and a fourth node;

a first light emission control transistor electrically connected between the first node and the second node;

a second light emission control transistor electrically connected between the fourth node and a reference voltage line;

a first scan transistor electrically connected between the fourth node and a corresponding data line among the plurality of data lines;

a second scan transistor electrically connected between the second node and the third node;

a third scan transistor electrically connected between the first node and the reference voltage line; and a data control transistor connected to the corresponding data line, the data control transistor being configured to connect and disconnect the first driving circuit with the data line based on a sampling signal, wherein a gate node of the first scan transistor, a gate node of the second scan transistor, and a gate node of the third scan transistor are electrically connected in common to a single scan line among the plurality of scan lines.

2. The display device of claim 1, wherein the gate node of the first light emission control transistor and the gate node of the second light emission control transistor are electrically connected in common to a single light emission control line among the plurality of light emission control lines.

3. The display device of claim 1, wherein the data control transistor is disposed in the non-active area of the display panel and electrically connected to the first driving circuit.

4. The display device of claim 1, wherein a part or a whole of the driving voltage line overlaps with the reference voltage line; or a protrusion of the reference voltage line and the corresponding data line intersect and overlap with each other; or a protrusion of the reference voltage line and an active layer of the first scan transistor intersect and partially overlap with each other; or a part of an active layer of the first scan transistor and the corresponding data line overlap with each other.

5. The display device of claim 1, wherein a protrusion of a corresponding light emission control line among the plurality of light emission control lines is disposed between the first node and the second node.

6. The display device of claim 1, wherein the storage capacitor includes a first plate and a second plate, wherein the first plate is disposed in a same substance layer as a corresponding light emission control line among the plurality of light emission control lines or a corresponding scan line among the plurality of scan lines, and wherein the second plate is disposed in a same substance layer as one of the reference voltage line, the driving voltage line, and the corresponding data line.

7. The display device of claim 1, wherein a part of an active layer of the driving transistor overlaps with the storage capacitor, and wherein another part of the active layer of the driving transistor and the corresponding data line intersect and overlap with each other.

8. The display device of claim 1, wherein, when the first scan transistor, the second scan transistor and the third scan transistor are in a turned-on state, and the first light emission control transistor and the second light emission control transistor are in a turned-on state, a reference voltage is provided to the second node, the third node, and the fourth node, and the data control transistor is turned off.

9. The display device of claim 8, wherein, when the data control transistor is turned off, the first driving circuit and the data line are electrically isolated from each other.

10. The display device of claim 1, wherein, when the first scan transistor, the second scan transistor, the third scan transistor and the data control transistor are turned on and a data voltage is provided to the fourth node, the first light emission control transistor and the second light emission control transistor are in a turned-off state.

11. The display device of claim 1, wherein, when the first scan transistor, the second scan transistor, the third scan transistor, the first light emission control transistor and the second light emission control transistor are in a turned-off state, the data control transistor is turned off.

12. The display device of claim 1, wherein, when the first scan transistor, the second scan transistor, and the third scan transistor are turned off, the data control transistor is turned on, and the first light emission control transistor and the second light emission control transistor are turned on, a voltage of the fourth node changes and the light emitting device emits light.

13. The display device of claim 1, wherein, during a first period, a reference voltage is provided to both a first plate and a second plate of the storage capacitor, and the data control transistor is turned off and the second plate is electrically disconnected from the first driving circuit; and during a second period after the first period, as the data control transistor is turned on, the second plate and the first driving circuit are electrically connected to each other.

14. The display device of claim 1, wherein an area of each of the plurality of sub-pixels includes a circuit area, a light emission area, and a transparent area, wherein the driving transistor, the first, second and third scan transistors, the first and second light emission control transistors, and the storage capacitor are disposed in the circuit area, wherein the light emission area overlaps with the circuit area, and wherein the transparent area is an edge area of the circuit area and the light emission area.

15. The display device of claim 14, wherein the plurality of sub-pixels include a first sub-pixel and a second sub-pixel adjacent to each other in a first direction, wherein a signal wiring in the first sub-pixel is disposed along a second direction and in a side of the first sub-pixel that is opposite to a boundary between the first sub-pixel and the second sub-pixel, wherein a signal wiring in the second sub-pixel is disposed along the second direction and in a side of the second sub-pixel that is opposite to the boundary between the first sub-pixel and the second sub-pixel, and wherein the boundary between the first sub-pixel and the second sub-pixel is free of signal wirings disposed along the second direction.

* * * * *